US007225738B2

(12) United States Patent
Underwood et al.

(10) Patent No.: US 7,225,738 B2
(45) Date of Patent: Jun. 5, 2007

(54) EYE MARKS IN IMAGE PROCESSING

(75) Inventors: John A. Underwood, Vancouver, WA (US); Bruce Zignego, Vancouver, WA (US); Wolfgang Spitzke, Barsbuettel (DE); Roland Schroeder, Hamburg (DE); Joachim Wagner, Hamburg (DE)

(73) Assignee: Hewlett-Packard Development Company, L.P., Houston, TX (US)

( * ) Notice: Subject to any disclaimer, the term of this patent is extended or adjusted under 35 U.S.C. 154(b) by 368 days.

(21) Appl. No.: 10/719,559

(22) Filed: Nov. 21, 2003

(65) Prior Publication Data

US 2004/0226467 A1 Nov. 18, 2004

Related U.S. Application Data

(60) Provisional application No. 60/450,836, filed on Feb. 28, 2003.

(51) Int. Cl.
*B41F 1/54* (2006.01)

(52) U.S. Cl. ..... 101/484; 101/483; 101/211

(58) Field of Classification Search ..... 101/483–485, 101/211; 358/1.1, 1.4, 1.9; 235/456, 459, 235/494

See application file for complete search history.

(56) References Cited

U.S. PATENT DOCUMENTS 3,835,297 A * 9/1974 Inoue et al. ..... 235/469
3,948,125 A 4/1976 Hujer et al.
3,992,965 A 11/1976 Hell et al.
4,161,899 A 7/1979 Strune
4,606,633 A * 8/1986 Jeschke et al. ..... 356/237.5
4,721,058 A 1/1988 Hayamizu et al.
4,852,485 A * 8/1989 Brunner ..... 101/211
5,286,317 A 2/1994 Treat et al.
5,355,001 A * 10/1994 Fujimoto et al. ..... 235/494
5,388,387 A 2/1995 McElvy
5,432,586 A 7/1995 Tokuda
5,470,300 A 11/1995 Terranova
5,635,704 A 6/1997 Del Signore, II et al.
5,696,890 A * 12/1997 Geissler et al. ..... 358/1.9
5,765,460 A 6/1998 Wathieu
5,963,757 A 10/1999 Factor
6,027,820 A 2/2000 O'Hagan et al.
6,053,107 A 4/2000 Hertel et al.
6,109,183 A * 8/2000 Papritz et al. ..... 101/484
6,112,658 A 9/2000 Gunther et al.
6,160,609 A 12/2000 Inoue
6,196,098 B1 3/2001 Hagiwara et al.
6,408,599 B1 6/2002 Nakagawa et al.
6,439,095 B1 8/2002 Sugiyama et al.
2002/0144578 A1 10/2002 Mikkelsen et al.

* cited by examiner

*Primary Examiner*—Minh Chau

(57) ABSTRACT

Systems, methods, and devices for eye marks in image processing are provided. A method includes providing an eye mark having at least two sections arranged along a longitudinal axis, wherein each section includes a border common to both sections and a unique characteristic relative to other sections. The method also includes encoding instructions in the eye mark based upon the combination of the at least two sections.

15 Claims, 19 Drawing Sheets

EYE MARKS IN IMAGE PROCESSING

This application claims the benefit of U.S. Provisional Application No. 60/450,836, filed Feb. 28, 2003.

The printing industry often has used large sheets of print media to print several images, such as photographs, on a sheet. This allows a print device to print the several images in a single print cycle, thereby reducing the amount of wear on the device, among other things. However, once the images are printed, they then need to be separated from each other. Often times the separation of the images is accomplished by one or more cutting blades that slice the material between two or more images, thereby separating them from each other.

Additionally, the industry has utilized the use of a hole punch to mark a sheet of material with a hole which indicates where the sheet is to be cut in order to separate the images. These holes, indicating a cut position, are often referred to as cut marks. Traditionally, a plurality of images were placed serially on a web of print media with a cut mark punched in the space between two images. The web was then run through a cutting machine that would automatically detect each cut mark and would cut the web where each hole was positioned thereon.

More recently, some proposed techniques have provided single monochrome printed cut marks instead of punched holes. This allowed for printers to be utilized without the use of a punch mechanism, thereby eliminating a step in the printing process. However, there are several drawbacks to this technique.

For example, it is often difficult to distinguish between a cut mark and a feature within an image. Additionally, tears in the print media, splice marks, and debris, among others, on the surface of the print media can falsely trigger the cutting mechanism, which leads to wasted print media, excess wear on the machinery, and wasted time.

Another problem with this technique is that the mark might be lightly formed by the print device and, therefore, not detectable by the mark sensors, thereby leaving two images connected together. This can lead to a waste of resources by requiring the manual separation of the images.

Cut marks have also been used to convey information. In order to convey information, the punched cut marks were still positioned between two adjacent images, but the location within the space was alternated between two positions. For instance, information was conveyed in a binary pattern wherein a cut mark positioned on one side of the web was a 0 and wherein a cut mark positioned on the other side was a 1. However, this method of conveying information was slow, since the space between each image only had one cut mark and, therefore, only one bit of information could be conveyed with each image.

DETAILED DESCRIPTION

Figure 1A:
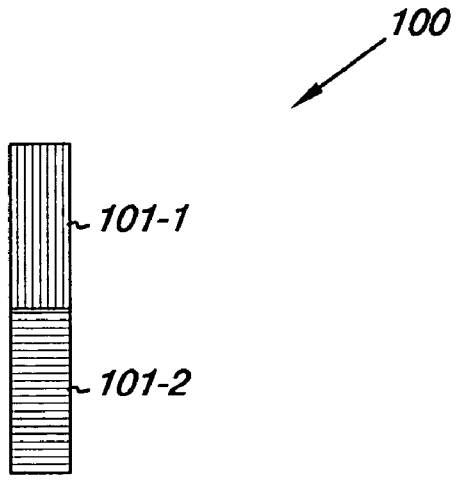
FIG. 1A illustrates an embodiment of an eye mark.

FIG. 1A illustrates an example of an embodiment of an eye mark according to the teachings of the present invention. The embodiment of FIG. 1A includes an eye mark 100 having two distinct sections 101-1 to 101-2. In various embodiments, eye marks of the present invention can include one or more sections, the invention is not limited to two distinct sections.

In various embodiments of the present invention, eye marks have at least two characteristics. Various types and the various number of characteristic are applicable to embodiments of the present invention. By way of example and not by way of limitation, suitable types of characteristics include, but are not limited to, colors, locations, shapes, sizes, widths, binary coding, combinations of one or more characteristics, and the like.

The embodiment illustrated in FIG. 1A has two sections, 101-1 and 101-2, with each section having one or more unique characteristics. For instance, sections 101-1 and 101-2 are different colors and are each in a different position with respect to each other and also with respect to the section's location on a print media. Each of these distinguishing characteristics can allow each eye mark, formed by one or more of these sections, to be differentiated from other eye marks and/or other print media content, e.g. images. Therefore, each eye mark can impart a meaning that is different from eye marks having one or more sections with other characteristics. Further, when any number or combination of sections, e.g. 101-1 and 101-2, is utilized, the number of meanings, or encodable information increases.

By way of example and not by way of limitation, the embodiments of FIG. 1A can include a choice of different colors, such as Cyan, Magenta, Yellow (CMY), and the like, for application in each of the two sections, 101-1 and 101-2, in order to provide the one or more unique characteristics. A choice of a certain color in a given section, 101-1 and 101-2, (e.g. location) with respect to a choice of certain colors in another section, combination of sections and/or with respect to a location on a print media is used in various embodiments to encode information and/or identify the eye mark 100. For instance, when the color cyan is present in section 101-1, an eye mark 100 can have a meaning attributable to that color in that position on the print media. When the color Magenta is present in section 101-2, an eye mark 100 can have a meaning attributable to that color in that position on the print media. Thus, individual colors in individual sections can provide respective first meanings.

Additionally, when two or more color sections, e.g. sections 101-1 and 101-2, are coordinated the combination of the two colored sections can provide additional meanings, e.g. encoded information. That is, with the combination of particular colors, such as the color Cyan in section 101-1 and the color Magenta in section 101-2, an eye mark 100 can also provide a second meaning.

In various embodiments, more combinations can be created by changing the positions of the sections 101-1 and 101-2 with respect to each other. For example, more combinations can be created by orienting the sections 101-1 and 101-2 side by side (horizontally and/or vertically), above and below one another (horizontally and/or vertically), and well as by spacing apart the positions of the sections on a print media. The invention is not so limited. In various embodiments, as discussed in more detail below, more combinations are afforded by having more than two sections having different characteristics.

In various embodiments utilizing two or more color sections, the two or more color sections can be arrayed such that sensors can read the sections in parallel and thereby interpret meaning and/or information from the encoded eye marks at substantially the same time. By way of example and not by way of limitation, in the embodiment of FIG. 1A the two color sections 101-1 and 101-2 are aligned such that two sensors aligned above the color sections, 101-1 and 101-2, can sense a presence and/or absence of color within a section of the eye mark 100 as the eye mark 100 passes under the sensors.

Figure 1B:
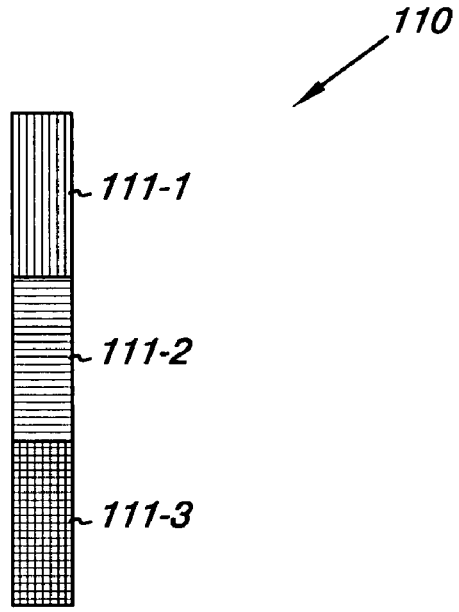
FIG. 1B illustrates another embodiment of an eye mark.

FIG. 1B illustrates an embodiment of an eye mark 110 having a combination of three color sections 111-1, 111-2, and 111-3. In the case illustrated by FIG. 1B, the combination of three color sections can provide an array of possible combinations. In binary terms ($2^N$), 8 bits of information can be encoded in eye mark 110. In various embodiments, each combination is capable of being assigned one or more meanings. As those skilled in the art will appreciate from this disclosure, various color(s) and or monochrome embodiments are considered within the scope of the present invention.

Figure 1C:
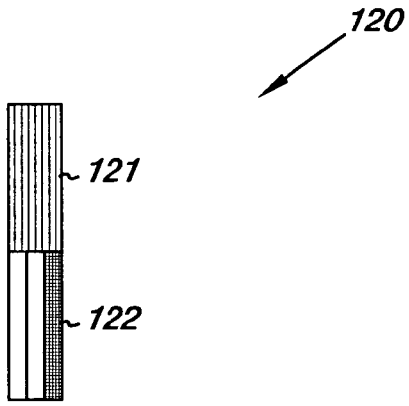
FIG. 1C illustrates another embodiment of an eye mark.

The embodiment of FIG. 1C illustrates another embodiment of an eye mark 120 according to the teachings of the present invention. In the embodiment of FIG. 1C, two different types of sections, 121 and 122, are illustrated for use as an eye mark 120. A first section 121 includes a color section 121 which can be encoded with various colors for various meanings. A second section 122 includes a monochrome, binary bit section 122. In the embodiment of FIG. 1C, the binary bit section 122 includes 3 bits which can be encoded, in a monochrome manner or otherwise, with various meanings. The invention, however, is not so limited. Further, as described above, other combinations can be created by orienting the sections 121 and 122 side by side (horizontally and/or vertically), above and below one another (horizontally and/or vertically), and well as by spacing apart the positions of the sections on a print media. Thus, FIG. 1C illustrates an embodiment of an eye mark 120 having a combination of a color section 121 and a binary bit section 122. The use of one or more binary bit sections, e.g. 122, can allow for the communication of information through the serial reading of the bits by a sensor, wherein one bit is read after another in series.

As shown in FIG. 1C, the combination of a single color section 121 with a single binary section 122 allows different meanings for each binary bit combination with each color utilized. For instance, when used with the color cyan, an eye mark 120 can have meanings attributable to each bit and combination of bits in the binary bit structure of binary section 122. In the case of a three bit binary structure, such as that shown in the binary bit section 122 of FIG. 1C, the structure can have eight different combinations, representing various encoded information, for each particular color associated therewith in color section 121.

Figure 1D:
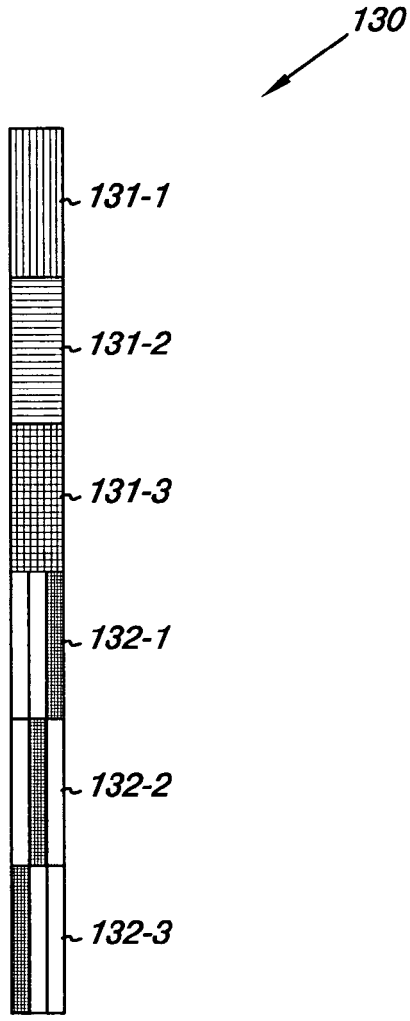
FIG. 1D illustrates another embodiment of an eye mark.

FIG. 1D illustrates another example of an embodiment of an eye mark according to the teachings of the present invention. The embodiment of FIG. 1D includes an eye mark 130 having six distinct sections 131-1 to 131-3 and 132-1 to 132-3. In the embodiment of FIG. 1D, sections 131-1, 131-2, and 131-3 are all different color sections and are each in a different position with respect to each other and with respect to location on a print media. With respect to sections 132-1, 132-2, and 132-3, these sections each include a binary bit structure, with each bit location carrying a different meaning or purpose. The various embodiments shown in FIGS. 1A–1D provide an array of possible combinations for encoding information and/or identifying eye marks.

The eye marks included within of the present invention can contain encoded instructions to perform a variety of functions with respect to one or more images, content, and print media upon which the images, content, and/or eye marks are printed. The various embodiments for the eye marks themselves can be used to verify that a mark is an eye mark and not a false mark such as a piece of debris, content in an image, or the like. Further, the various embodiments for the eye marks can also provide information, such as BCD coding, spread identity coding, print finish coding, beginning/end of a set of images, and the like, as will be known and understood by those of ordinary skill in the art upon reading this disclosure. The invention is not so limited.

The various embodiments for eye marks, described herein, can be utilized to provide information in the form of one or more process instructions. For example, eye marks can provide one or more instructions to indicate where a cutting device is to cut print media. Further, eye marks can instruct a device to perform an operation on print media. For example, such operations include moving one or more images, adding a feature to one or more images, such as a matte or glossy finish, or sorting or collating one or more images, among others.

As stated above, a single section, such as 101-1 of FIG. 1A, can be utilized to provide instructions for one or more functions, e.g. to indicate where a device is to cut a print medium or to provide information such as an instruction on how to operate on the print medium. When utilizing a single section, the eye mark can be utilized to distinguish one piece of information or instruction from the next by using marks having different characteristics, such as different colors and/or different binary bit values, among others. Additionally, the marks can be located in different positions within an area between two images. As stated above, the change in location can also act as a characteristic to differentiate one mark from the next.

When utilizing multiple sections, such as is the case with the embodiments of FIGS. 1A–1D, the combinations of characteristics can provide a large number of possible meanings. Many different types of information and/or instructions can be encoded within one or more various eye mark embodiments. For example, an eye mark can be encoded with information by linking information such as instructions to a specific configuration of the one or more sections of an eye mark. For example information can include, an order number, batch number, spread identity code, and BCD coding, among others. Examples of instructions that can be provided include, beginning/end of a print job, beginning/end of an order, beginning/end of a batch, beginning/end of a waste area, beginning/end of a paper splice, beginning/end of a calibration function, instruction to back print, print finishing instructions, and slitter control instructions, among others as the same will be appreciated by one of ordinary skill in the art.

FIGS. 2–4B show different ways in which images can be oriented on print media. Various eye mark embodiments are shown thereon to illustrate some of the functions the various eye mark embodiments can provide. Although images are represented as pictures or boxes in this disclosure, the term "images" can represent any printed item on print media including, but not limited to, pictures, text documents, and combinations of images and text, among others. Additionally, those skilled in the art will appreciate from reading this disclosure that print media can be of various types and can take various forms. Suitable examples of the various types of media include, but are not limited to, paper, plastic, and cloth, among others. Further, an example of a suitable form of media includes, but is not limited to, one or more sheets of media ranging in size from individual sheets (or smaller) to continuous webs of media.

Figure 2:
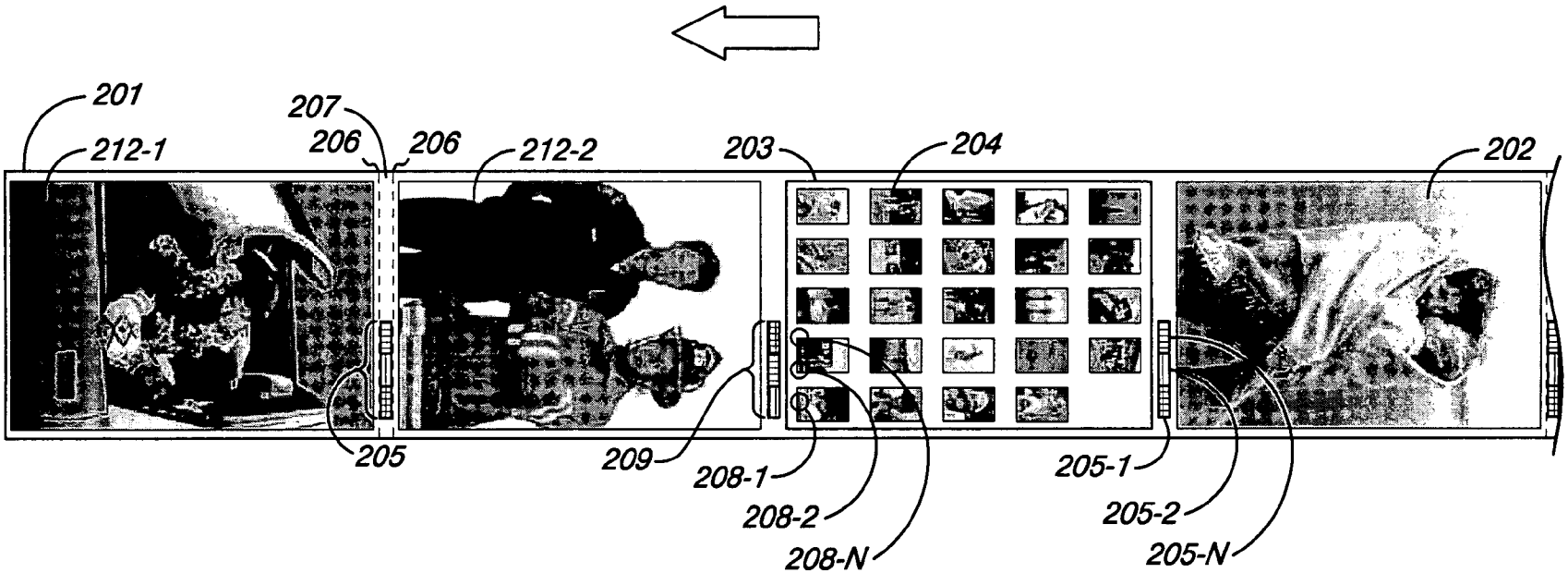
FIG. 2 illustrates a serial arrangement of images embodiment.

FIG. 2 illustrates an arrangement of images and various embodiments of eye marks included on a print media 201. In the embodiment of FIG. 2, the images are laid out on the print media 201 in a single serial arrangement. As illustrated by the directional arrow in FIG. 2, the sheet of print media 201 is depicted as progressing from right to left typically through a processing device or processing system. Processing devices and/or systems can include multiple device components operable to perform one and/or many functions, e.g. a printing component, a cutting component, and/or a finishing component, among others. The invention is not limited to the direction of progression shown in the Figures. Further, as those skilled in the art will appreciate from reading this disclosure, the invention can be adapted to operate on any device or system wherein eye marks can be utilized.

The embodiment of FIG. 2 is intended to illustrate the use of various features of the present invention. In particular, in the embodiment shown in FIG. 2, an intersection of two print jobs, for example two customer image orders, on print media 201 is illustrated. A customer order is one or more images that are grouped together. Examples of customer orders include one or more prints from one or more rolls of film, one or more reprints, one or more prints from digitally stored media, and the like.

In the embodiment of FIG. 2, images 212-1 and 212-2 are part of a first customer order. In the embodiment of FIG. 2, a proof sheet 203 begins a new customer order, or group of images. A proof sheet, such as that shown at 203, typically has a thumbnail image 204 of each full sized image, such as image 202, to be printed in a customer order. A proof sheet typically also lays out the thumbnails 204 in the order that they are to be printed. The invention, however, is not so limited, By way of example and not by way of limitation, image 202 is the first image of the second customer order and its thumbnail representation 204 is provided in the upper left hand corner of the proof sheet 203 to illustrate that it is the first image 202 in the customer order. The proof sheet 203 need not be the first item in a new order and that the order of the images 202 need not be as shown thereon.

Additionally, within a customer order or otherwise, images, e.g. 202, 203, 212-1, and 212-2 are to be eventually separated from each other. For this purpose, an eye mark 205 is provided in a blank space or open region 207, to indicate to a device that a cutting operation should occur. A cutting operation can separate two images in a space between the images so as not to cut the images themselves. This space is illustrated as the space between dotted-lines 206. The dotted-lines 206 are not necessarily present on the print media. In various embodiments, eye marks contain the information to identify a cut location (e.g. between dotted-lines 206) to a cutting component (not shown).

In various embodiments, as shown in the embodiment of FIG. 2, an eye mark is positioned between two adjacent images, e.g. 212-1 and 212-2, within the cutting space (e.g. space between the dotted-lines 206). In these embodiments, when the print media 201 is cut the region 207 including the eye mark 205 is removed from the print media 201 and adjacent images, e.g. 212-1 and 212-2, are separated. In various embodiments, an eye mark 205 is sized to fit within the region 207 to be removed by the cutting operation.

In various embodiments, an eye mark 209 can have a different pattern than eye mark 205. This difference, for example, can indicate that the adjacent images 212-2 and 203 are part of different sets of images. A set of images can be any set of one or more images, including, but not limited to customer orders, batches, spliced sheets, or other such groups of print media content. Thus, a detected change in an eye mark, according to various embodiments of the invention, can indicate the start of a new customer order and provide instructions to sort the next set of images into a separate stack or area. The invention, however, is not so limited.

Eyemarks such as 205 and 209 are detected by a sensor array including one or more sensors. The sensors can be designed to identify specific characteristics of the eyemarks or the sections that form them. For example, in FIG. 2, a sensor array includes several sensors 208-1, . . . , 208-N illustrated thereon. In this embodiment, the sensors 208-1, . . . , 208-N are stationary and the print media moves past such that each sensor monitors an area of the print media 201 that should contain a specific section of an eyemark 205/209. When an eyemark 205/209 passes by the sensors 208-1, . . . , 208-N, the eyemark 205/209 is identified and its encoded information is interpreted.

By way of example and not by way of limitation, in the embodiment of FIG. 2 the eye marks, such as eye mark 205 have three color sections 205-1, 205-2, and 205-N. The number of sections utilized is not limited to three and can include more or less sections according to the various embodiments. The colors, 205-1, 205-2, and 205-N, and their arrangement can provide instructions which can be operated on to direct or control a machine. That is, the colors, 205-1, 205-2, and 205-N, can contain instructions which can be detected and/or read according to one or more sets of computer executable instructions and operated on by one or more sets of computer executable instructions to indicate that the mark is an eye mark and to indicate where a print medium is to be cut.

The colors can be different from each other and can, therefore, create unique patterns to aid in distinguishing the eye mark from defects, debris, and image features, among others. Additionally, in various embodiments, primary or secondary colors are utilized in particular combinations and arrangements to help distinguish the marks from features within an image. Examples of primary colors and secondary colors in the image processing arts include, but are not limited to, cyan, magenta, yellow, red, green, blue, black, light cyan, and light magenta.

Operations that can be performed on each image can be different from one image to the next and the various embodiments of eye marks can contain the information to provide instructions to perform the different operations. Thus, the various eye mark embodiments, e.g. eye marks 205 and 209, can include information about the image or set of images and can include instructions on how the images and/or print media is to be handled with respect to a specific image or set of images.

Figure 3A:
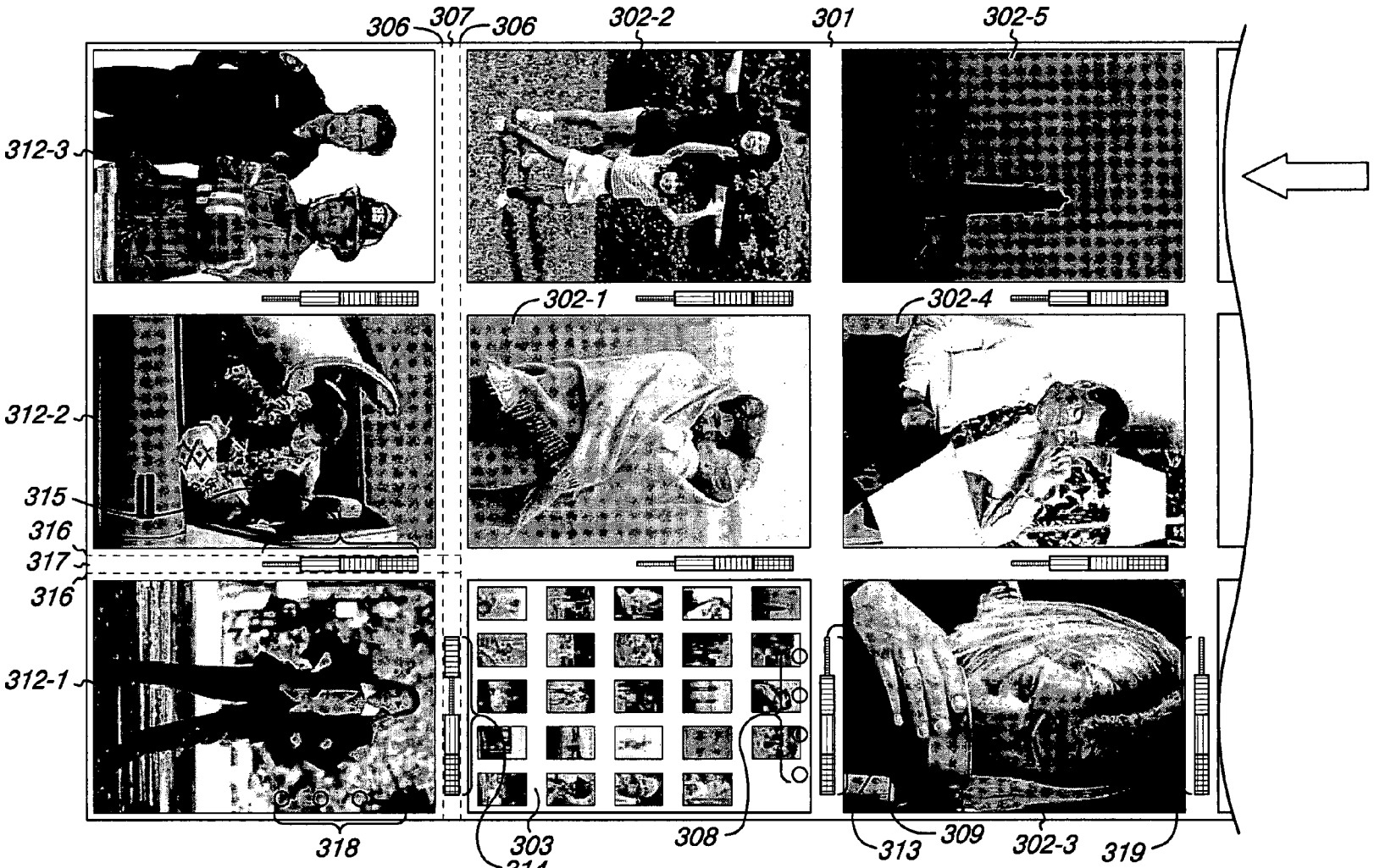
FIG. 3A illustrates a matrix arrangement of images embodiment.
Figure 3B:
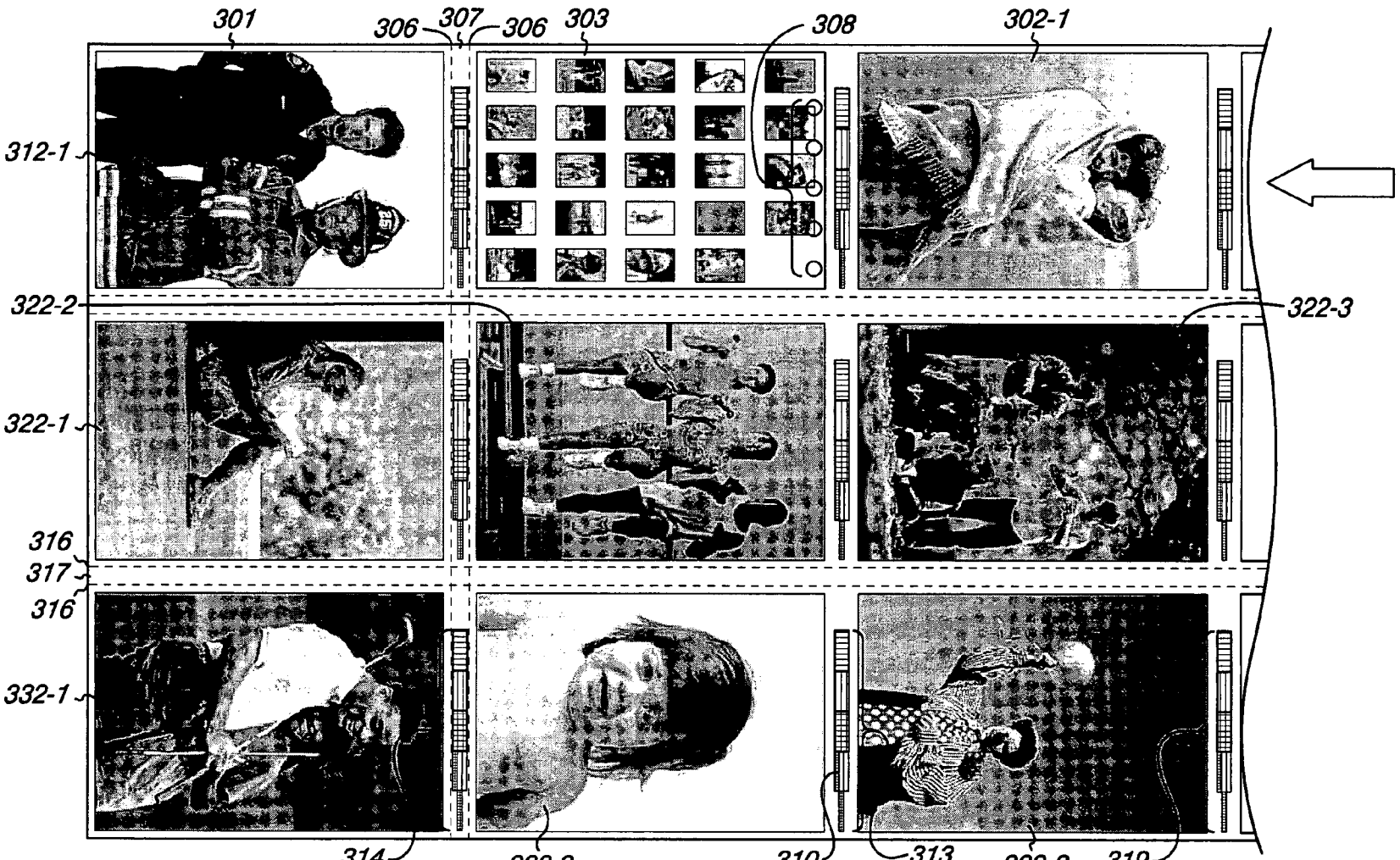
FIG. 3B illustrates another matrix arrangement of images embodiment.

In other embodiments of the invention, the sheet of material is wider and can accommodate several images across its width. FIGS. 3A and 3B illustrate two styles of formatting images in a matrix format for use on a wider sheet of media. Additionally, FIGS. 3A and 3B also include examples of other eye marks embodiments according to the teachings of the present invention.

In FIG. 3A, as in FIG. 2, the sheet of media 301 is again progressing from the right to the left. FIG. 3 also shows the end of a first order and the beginning of a second order. As in FIG. 2, the illustration in FIG. 3A has a first customer order including images 312-1, 312-2 and 312-3 and a second customer order including a proof sheet 303 and images 302-1 to 302-5.

The images in this embodiment are laid out such that as the sheet of material progresses to the left, a cut is intended to be made between the first vertical section of images (encompassing images 312-1 to 312-3) and the second vertical section of images (encompassing the proof sheet 303 and images 302-1 and 302-2) as generally indicated at 307. For this purpose, an eye mark 314 is provided to indicate to a device that a cutting operation should occur.

A cutting operation can separate the vertical sections of images in a space between the images so as not to cut the images themselves. This space 307 is illustrated as the space between dotted-lines 306. The dotted-lines 306 are provided to illustrate where a cutting component could cut the print media 301. These lines 306 are illustrative and therefore are not necessarily present on the print media.

In various embodiments, eye marks contain the information to identify a cut location (e.g. between dotted-lines 306) to a cutting component (not shown). In various embodiments, as shown in the embodiment of FIG. 3A, an eye mark is positioned between the two vertical sections of images, e.g. within the cutting space (e.g. space between the dotted-lines 306). In these embodiments, when the print media 301 is cut the region 307 including the eye mark 314 is removed from the print media 301 and the two vertical sections of images are separated. In various embodiments, an eye mark 314 is sized to fit within the region 307 to be removed by the cutting operation.

In addition to colored sections of the eye marks shown previously in FIG. 2, the eye marks 313, 314, 315, and 319 illustrated in FIG. 3A also include a trigger section 309 that indicates to the cutter where to center the cutting mechanism. In this embodiment, the sensor array 308 includes an additional sensor that is utilized to sense the trigger section 309.

In various embodiments, once the first vertical section of images is detached from the sheet of media 301, the first vertical section is cut again, this time between the bottom image 312-1 and the middle image 312-2. For this purpose, an eye mark 315 is provided to indicate to a device that a cutting operation should occur. A cutting operation can separate horizontal sections of images in a space between the images so as not to cut the images themselves. This space 317 is illustrated as the space between dotted-lines 316. The dotted-lines 316 are provided to illustrate where a cutting component could cut the print media 301. These lines 316 are illustrative and therefore are not necessarily present on the print media.

In various embodiments, eye marks 315 contain the information to identify a cut location (e.g. between dotted-lines 316) to a cutting component (not shown). In various embodiments, as shown in the embodiment of FIG. 3A, eye marks, e.g. 315 are positioned between the horizontal sections of images, e.g. within the cutting space (e.g. space 317 between the dotted-lines 316). In these embodiments, when the print media 301 is cut the region 317 including the eye mark 315 is removed from the print media 301 and horizontal sections of images are separated. In various embodiments, eye marks, e.g. 315, are sized to fit within the region 317 to be removed by the cutting operation. In this manner, images such as images 312-2 and 312-3 can be separated. By separating the images in this way, the order of the images is maintained throughout the process of separating them. In this embodiment, a second sensor array of one or more sensors 318 is illustrated. In this embodiment, these sensors 318 are arranged to read the sections of the eyemark 315 as it moves vertically by the sensors 318. However, the invention is not so limited.

In this embodiment, since image 312-3 is the end of the first order, the eye mark 314 can be encoded with information, such as identification of the next image as the start of the second order, and/or instructions on what operations to perform on the previous and next images. For example, the eye mark can indicate that the previous images should be stacked in one pile and that the new, a second customer order, should be stacked in a second pile or turned before stacking such that the first order and second order are collated. However, the invention is not so limited.

FIG. 3B illustrates another style of arranging the images in a matrix format and includes a binary encoding section for an eye mark. This embodiment is configured such that serial strips, progressing from left to right, are to be separated from each other and then processed, for example, as shown and described in FIG. 2. However, the invention is not so limited. Accordingly, in this embodiment, areas between the serial rows of images, such as area 317 will be removed by a cutting component at dotted-lines 316. By cutting across these lines 316, three serial strips of images are formed.

In this embodiment, three rows of images are arranged horizontally in FIG. 3B with the images in each row being serially arranged from left to right and the sheet of material 301 progressing from right to left. For example, image 312-1 represents the end of a first customer order and proof sheet 303 illustrates the beginning of a second customer order with image 302-1 being the first image in the second customer order. The images 322-1 to 322-3 are part of a separate set of orders and are unrelated to the first and second orders described previously. Additionally, images 332-1 to 332-3 are unrelated to the images of 322-1 to 322-3 or the images of the first and second customer orders.

The eye mark illustrated in FIG. 3B includes a binary encoding section that allows for additional information to be encoded therein. The eye mark as shown, includes a three bit section 310 wherein the section is divided into three segments with each segment representing one bit of binary data. The combined three bit binary structure as shown in FIG. 3B can provide a decimal representation from 0–7. As those skilled in the art will appreciate from reading this disclosure, more than one binary section can be utilized in an eye mark according to the teachings of the present invention. Additionally, the array of one or more sensors 308 includes an additional sensor to detect the additional section 310.

Figure 4A:
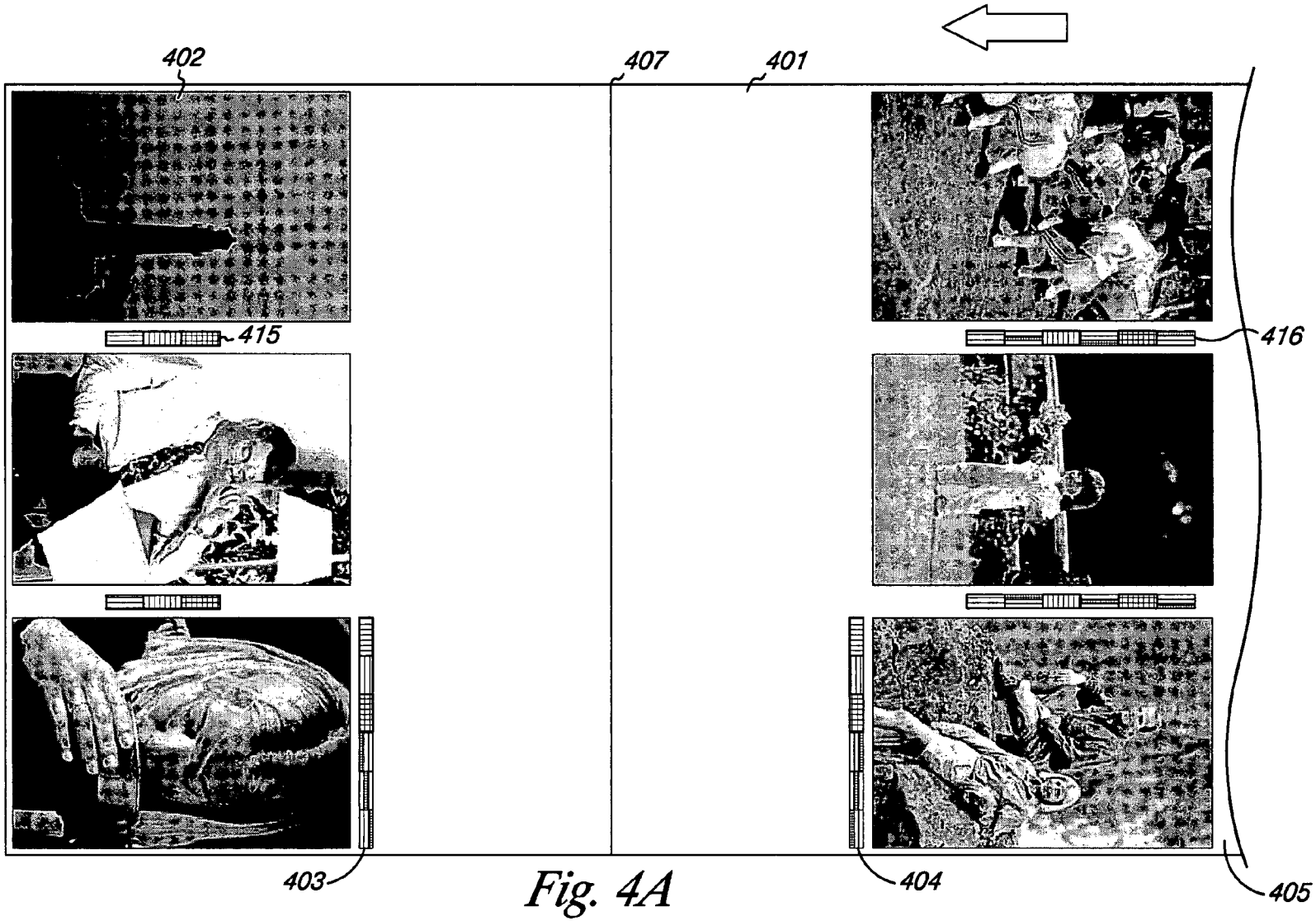
FIG. 4A illustrates a matrix arrangement of images embodiment containing a splice thereon.
Figure 4B:
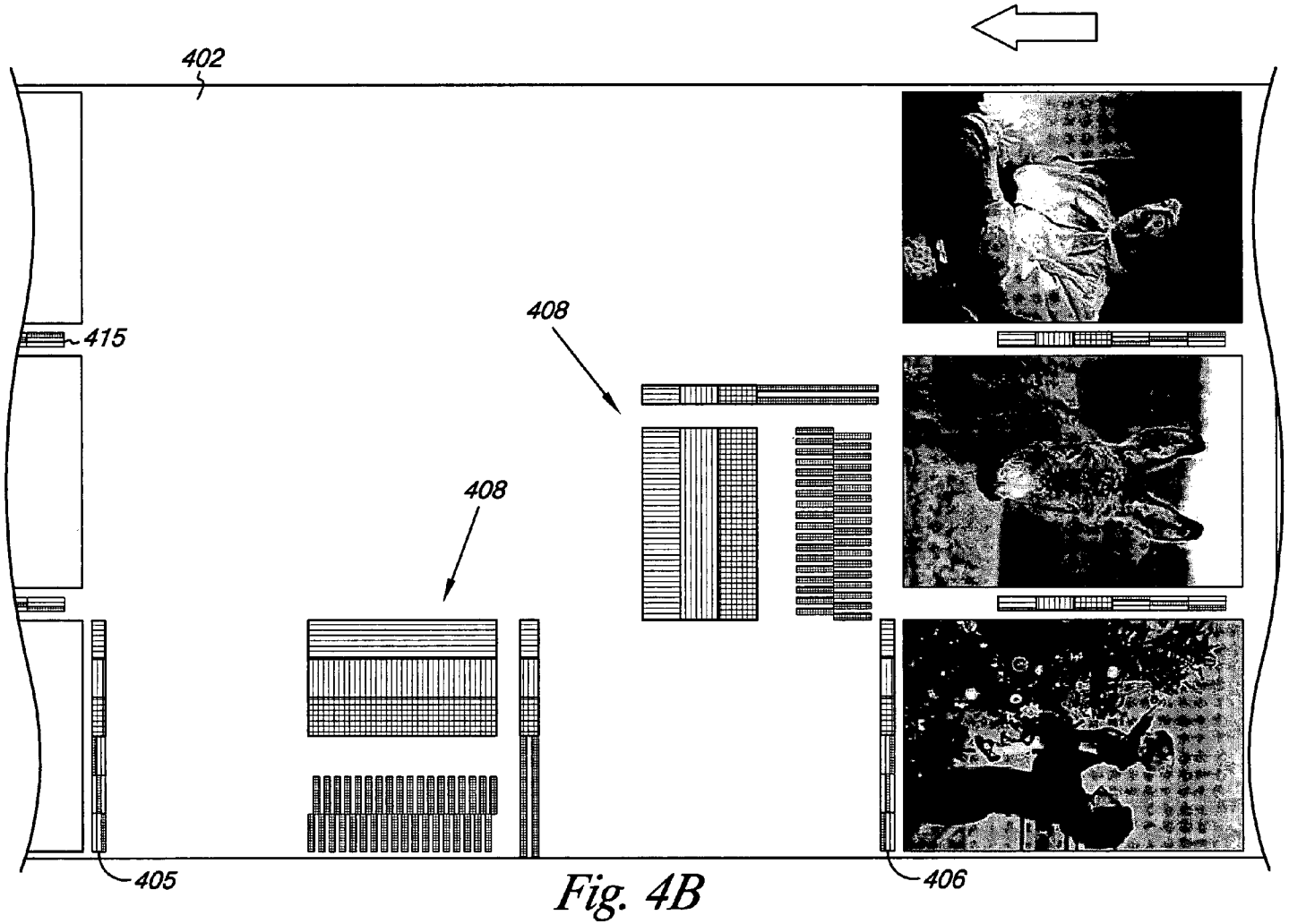
FIG. 4B illustrates a matrix arrangement of images embodiment containing device calibration information thereon.

FIGS. 4A and 4B illustrate several other uses for eye marks and another type of eye mark configuration. In FIG. 4A, one sheet of print media has been spliced to another piece of print media at splice line 407. An eyemark 403 can be utilized to indicate that the cutting mechanism should cut the media at mark 403 and can indicate that the next segment of the print media contains a splice mark 407. Eye mark 404 can also be used to indicate when to cut the print media, but also that the splice has passed. At least one of these eye marks 403 and/or 404 can also include instructions on how to deal with the waste media containing the splice mark. Additionally, FIG. 4A shows an embodiment wherein eyemarks 415 having three sections and eyemarks having six sections 416 are utilized together on the media 401. Those skilled in the art will appreciate from this disclosure that any number of different eyemark formats can be utilized during processing of the media.

In FIG. 4B, a set of calibration information, in this case mark sensor calibration information 408, has been incorporated into print media. An eyemark 405 can be utilized to indicate that the cutting mechanism should cut the media at mark 405 and can indicate that the next segment of the print media contains calibration information 408. Eye mark 406 can also be used to indicate when to cut the print media, but also that the mark sensor calibration information 408 has passed. At least one of these eye marks 405 and/or 406 can also include instructions on how to deal with the waste media containing the calibration information.

Various embodiments for eye marks have been described above according to the teachings of the present invention. The various eye mark embodiments, described herein, are operable for use with image processing equipment. FIGS. 5A–9B illustrate various operating environments, such as image processing equipment, that can include and can implement various embodiments of the present invention. Various embodiments considered within the scope of the present invention are not limited to the operating environments shown in FIGS. 5A–9B.

Various embodiments of the invention include a sensing device. Various embodiments of a sensing device operable on eye marks are discussed in connection with FIGS. 5A and 5B. Embodiments, however, are not limited to the sensing device discussed herein.

Figure 5A:
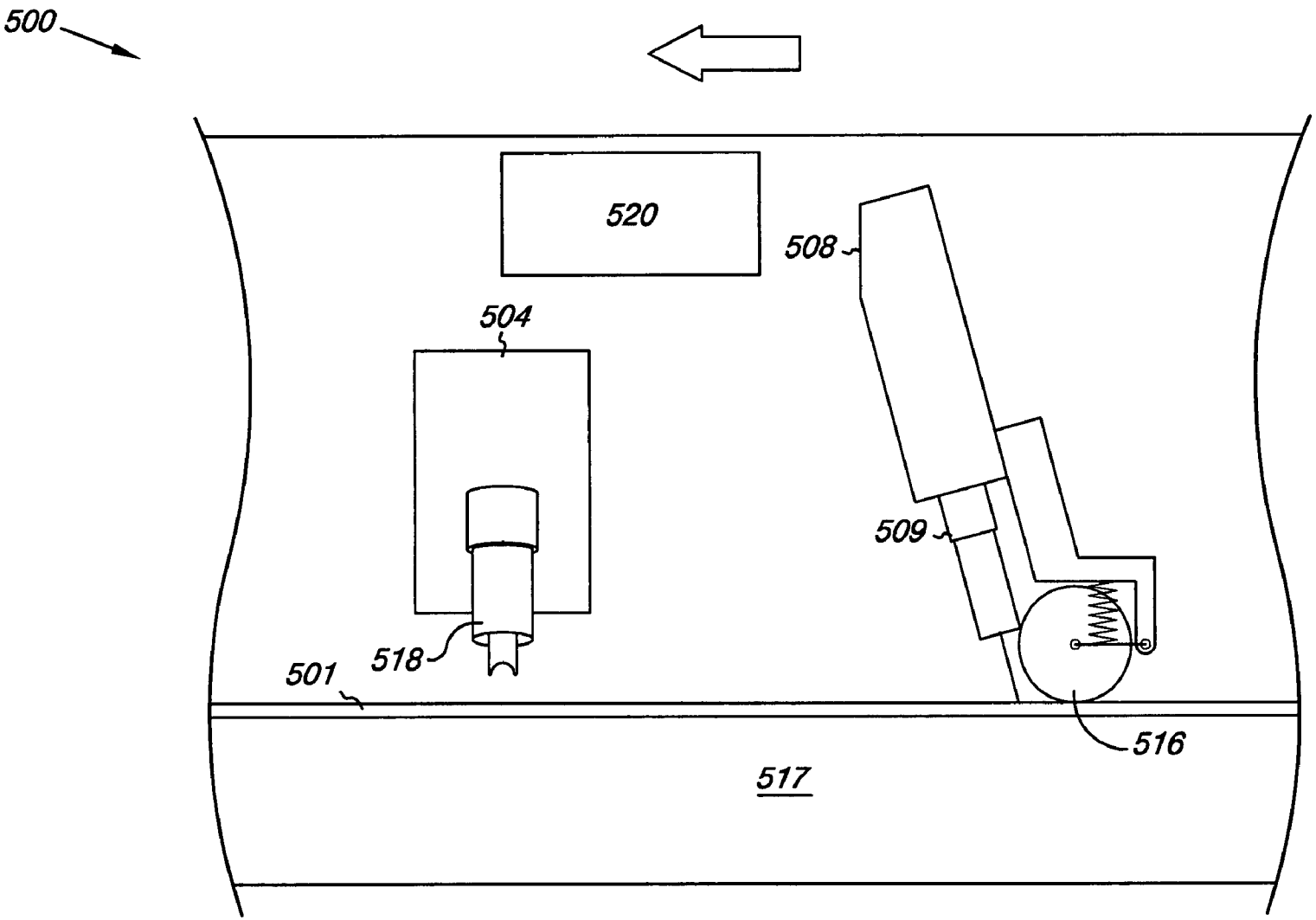
FIG. 5A illustrates a side view illustrating embodiments of sensing and cutting components.

FIG. 5A illustrates an embodiment of a portion 500 of an image processing device according to the teachings of the present invention. The embodiment in FIG. 5A illustrates a cutting device 504 and a sensing device 508. In the embodiment of FIG. 5A, the sensing device includes an eye mark sensing device 508. The embodiment in FIG. 5A, illustrates the cutting device 504 and the sensing device 508 operating on a continuous feed of print media 501. However, the invention is not limited to implementation with a continuous feed of print media. Various types of print media 501 are suitable for use with various embodiments of the invention. That is, in various image processing embodiments, the print media includes photo quality paper 501.

The print media 501 includes print media having processing instructions thereon. In various embodiments, the print media 501 having processing instructions includes a number of eye marks as the same have been described in detail herein. In various embodiments, the number of eye marks includes a number of eye marks operable to provide a first process instruction and a second process instruction. In various embodiments, a first process instruction includes a first process instruction to identify that a mark on the print media 501 is an eye mark. In various embodiments, a first process instruction includes a first process instruction to apply a particular finish to the print media 501. That is, by way of example and not by way of limitation, the first process instruction can include a process instruction to apply a matte finish to the print media 501.

In various embodiments, a second process instruction includes a second process instruction to cut the print media, e.g. into segments, at particular locations. The invention, however, is not limited to the examples stated herein. Many process instructions that can be included in various eye mark embodiments of the present invention.

In the embodiment illustrated in FIG. 5A, the sensing device 508 includes a wheeled mechanism 516 and one or more sensors 509. In the embodiment illustrated in FIG. 5A, the wheeled mechanism 516 acts to press the print media 501 down against a surface 517, such as a conveying surface. The wheeled mechanism 516 thus serves to aid in obtaining accurate sensing data as the print media 501 passes by the one or more sensors 509 of the sensing device 508.

According to various embodiments of the present invention, the one or more sensors 509 can include at least one color sensor operable to identify a color eye mark, as the same have been described herein. In various embodiments of the present invention, the one or more sensors 509 include at least one monochrome sensor operable to identify a monochrome eye mark, as the same have been described herein.

In the embodiment illustrated in FIG. 5A, the cutting device 504 includes a cutting component 518. Various types of cutting devices 504 and cutting components 518 are suitable for use with the present invention.

The embodiment shown in FIG. 5A, illustrates software means 520 included within the portion 500 of the image processing device. The software means 520 can include one or more sets of computer executable instructions operable to coordinate the functions of the sensing device 508 and the cutting device 504. That is, the software means 520 illustrated in FIG. 5A are operable on one or more hardware components such as one or more processors, one or more application modules, e.g. an encoder and the like, and one or more memory devices. One of ordinary skill in the art will appreciate the manner in which one or more sets of computer executable instructions are storable on one or more memory devices and can be operated on by one or more processors and one or more application modules. The invention is not so limited. That is, in various embodiments of the invention, information detected and/or received by the one or more sensors 509 of the sensing device 508 can be interpreted and operated on by the one or processors and/or one or more application modules according to the one or more sets of computer executable instructions.

By way of example and not by way of limitation, information detected and/or received by the one or more sensors 509 in the sensing device 508 can be operated on, according to the one or more sets of computer readable instructions, to identify eye marks as the same have been described in detail herein. Likewise, in various embodiments, information detected and/or received by the one or more sensors 509 in the sensing device 508 can be operated on, according to the one or more sets of computer readable instructions, to interpret information encoded in eye marks as the same have been described in detail herein. Thus, in various embodiments, the software means 520 is operable to interpret process information, of various types, provided by various eye mark embodiments of the present invention.

By way of example and not by way of limitation, information detected and/or received by the one or more sensors 509 in the sensing device 508 can be operated upon using the software means 520, in connection with other information, e.g. a speed at which the print media 501 is passing by the sensing device 508, in order to control or actuate the operation of the cutting component 518 in the cutting device 504.

Figure 5B:
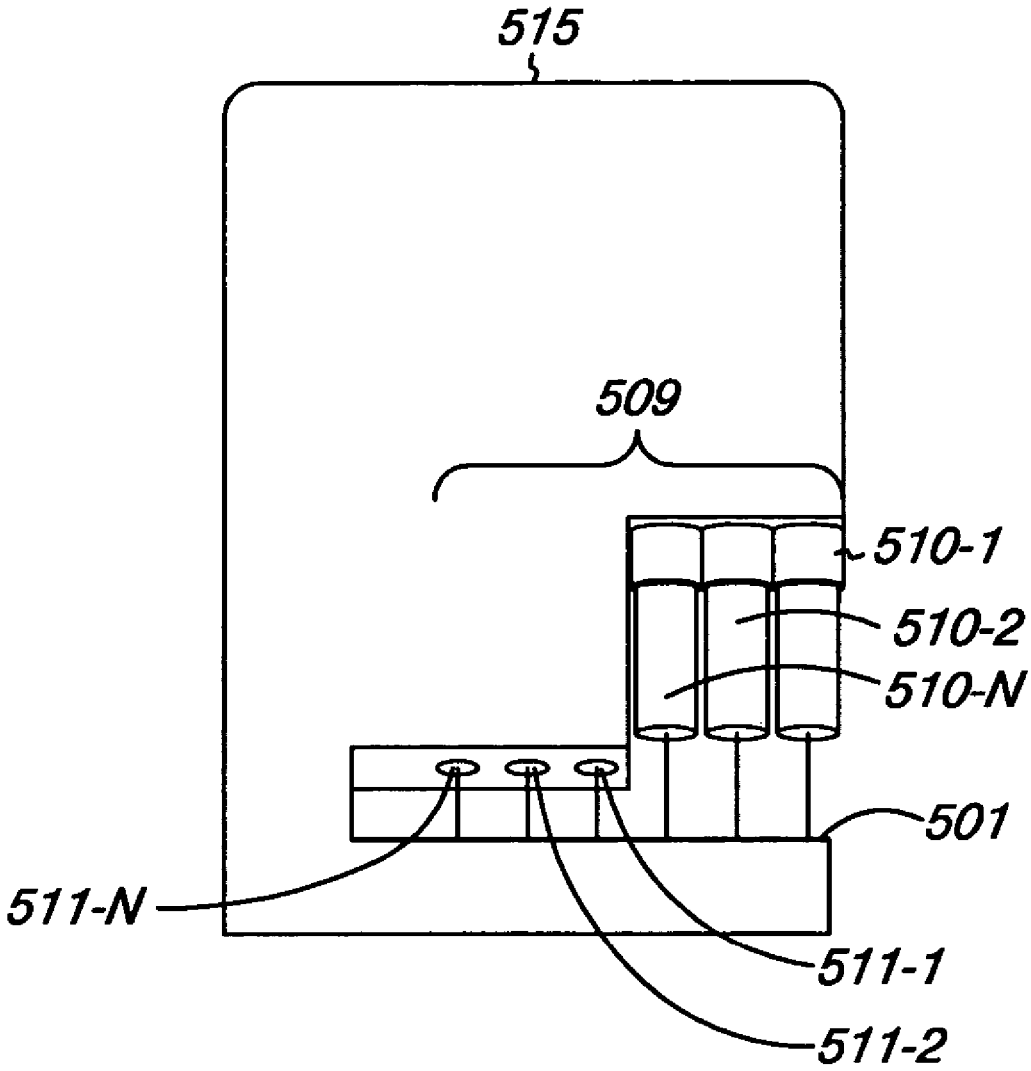
FIG. 5B illustrates an end view of the embodiment of a sensing component of FIG. 5A.

FIG. 5B illustrates an end view embodiment of the portion 500 of an image processing device shown in FIG. 5A. The embodiment of FIG. 5B illustrates a cross sectional view for the eye mark sensing device 508 described in connection with FIG. 5A. As described in connection with FIG. 5A, the eye mark sensing device 508 is operable on print media 501 having one or more eye marks as the same have been described in detail herein.

As described in connection with FIG. 5A, the eye mark sensing device 508 includes one or more sensors, shown in FIG. 5B as 510-1, 510-2, . . . , 510-N, 511-1, 511-2, . . . , 511-N. In the embodiment of FIG. 5B, one or more sensors, 510-1, 510-2, and 510-N, include color sensors operable to identify a color eye mark, as the same have been described in detail above. Thus, in various embodiments, sensor 510-1 can include a color sensor operable to detect a color cyan, sensor 510-2 can include a color sensor operable to detect a color magenta, and sensor 510-N can include a color sensor operable to detect a color yellow. However, the invention is not so limited. In various embodiments, a set of computer executable instructions are operable to interpret particular combinations of one or more colors detected by the one or more color sensors, 510-1, 510-2, and 510-N. And, as described in detail above, in various embodiments of the present invention, particular combinations of one or more colors detected by the one or more color sensors, 510-1, 510-2, and 510-N, can be interpreted by the set of computer executable instructions to identify an eye mark.

Various embodiments of the invention are not limited to the number of color sensors, 510-1, 510-2, and 510-N, shown in the embodiment of FIG. 5B. Thus, more or fewer color sensors are considered within the scope of the present invention. Likewise, various embodiments of the invention are not limited to a particular combination or order of the colors cyan, magenta, and yellow. Other colors and/or color combinations are considered within the scope of the present invention. In various embodiments, the one or more color sensors include color sensors to detect light cyan, and light magenta.

In various embodiments, as described above, a particular combination of colors detectable by the one or more color sensors, 510-1, 510-2, and 510-N, can include a combination of colors designed to encode processing information. Thus, in some embodiments, a particular color combination can serve two roles. That is, the particular combination of colors detectable by the one or more color sensors, 510-1, 510-2, and 510-N, can be processed, according to one or more sets of computer executable instructions, to identify an eye mark according to the teachings of the present invention. And, a particular combination of colors detectable by the one or more color sensors, 510-1, 510-2, and 510-N, can be processed, according to one or more sets of computer executable instructions, to interpret processing information useable to control image processing equipment and/or print media as the same are defined herein. The invention is not so limited.

In the embodiment of FIG. 5B, one or more sensors, 511-1, 511-2, and 511-N, include monochrome sensors operable to interpret processing instruction eye marks, as the same have been described in detail above. That is, in various embodiments, one or more sensors, 511-1, 511-2, and 511-N, include monochrome sensors operable to detect an eye mark having a three bit binary structure. According to various embodiments of the present invention, each bit in a three bit binary structure eye mark can encode a particular processing instruction. Thus, by way of example and not by way of limitation, a detected mark at a particular bit location can represent a one (1) and the absence of a mark at a particular bit location can represent a zero (0). According to various embodiments of the present invention, one or more sets of computer executable instructions are operable to interpret a 1 or a 0, detectable by the one or more sensors, 511-1, 511-2, and 511-N, at each bit location in an eye mark having a three bit binary structure, in order to implement a particular processing instruction.

In the embodiment shown in FIG. 5B, three sensors, 511-1, 511-2, and 511-N, are illustrated each of which is operable to interpret processing instructions from an eye mark having a three bit binary structure. Various embodiments of the invention can include more or fewer sensors operable to interpret processing instructions from an eye mark having a three bit binary structure.

In various embodiments, a set of computer executable instructions are operable to interpret particular combinations of one or more colors detected by the one or more color sensors, 510-1, 510-2, and 510-N, as identifying an eye mark location and accordingly the set of computer executable instructions will interpret a particular combination of bits in one or more three bit binary structure eye marks associated therewith, as detectable by the one or more sensors, 511-1, 511-2, and 511-N, in order to implement one or more processing instructions.

Various embodiments of the invention are not limited to eye marks having a three bit binary structure for encoding processing instructions. In various embodiments, a one bit eye mark can be used to encode processing instructions in combination with a color eye mark. Likewise, various embodiments of the present invention can include one or more eye marks having a two or more binary bit structure, as detectable by the one or more sensors, 511-1, 511-2, and 511-N. Various embodiments of the invention include a set of computer executable instructions, operable on an eye mark having a two or more binary bit structure and detectable by the one or more sensors shown in FIG. 5B as 510-1, 510-2, 510-N, 511-1, 511-2, . . . , 511-N, to identify an eye mark and to interpret one or more processing instructions encoded in the eye mark.

Various embodiments of the invention include a printing device. Various embodiments of a printing device operable for producing eye marks, as the same have been described herein, are discussed in connection with FIGS. 6A–6D. Additional printing devices operable for implementing the embodiments described herein are considered within the scope of the present invention. That is, embodiments of the invention are not limited to the printing devices discussed in FIGS. 6A–6D.

Figure 6A:
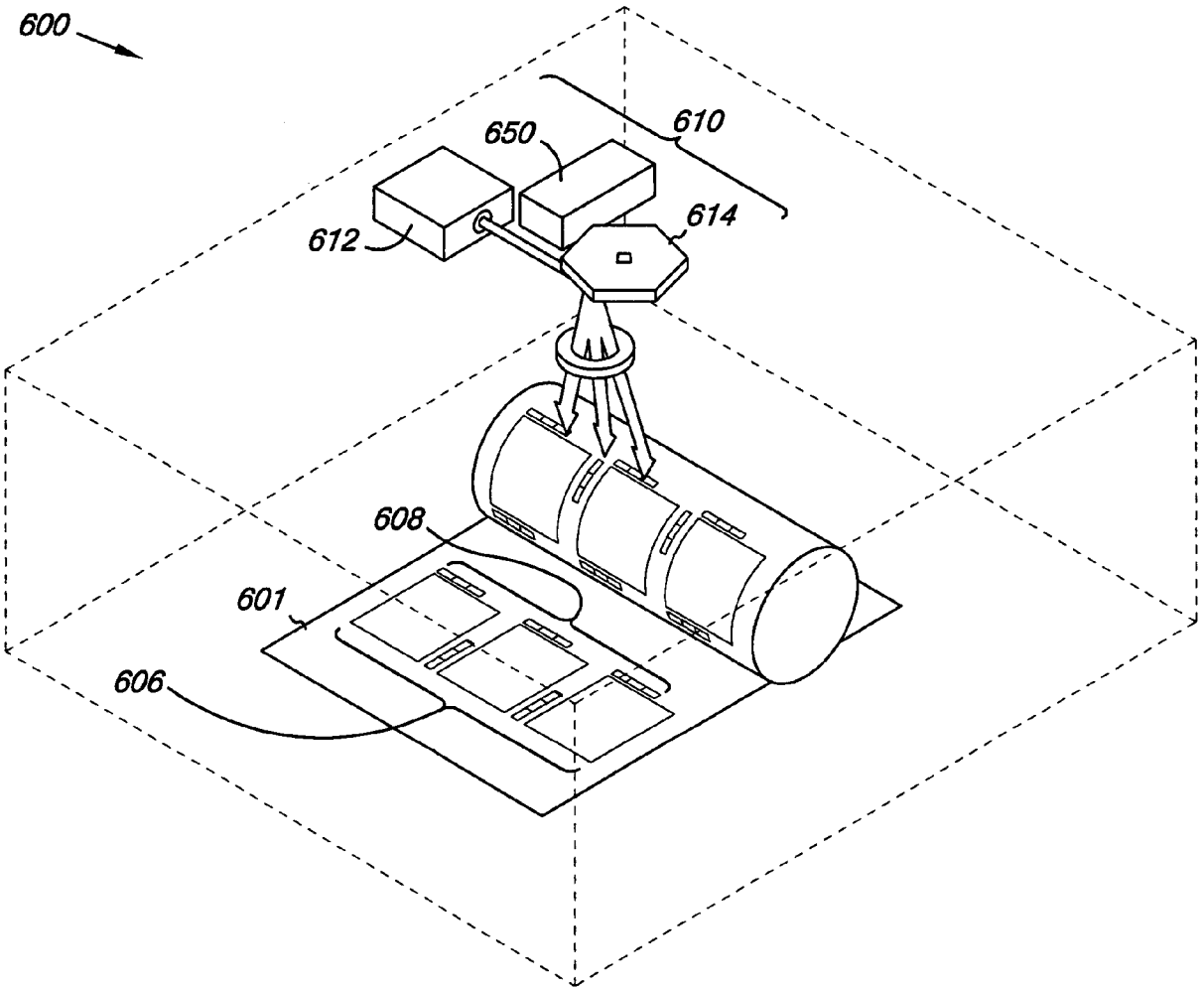
FIG. 6A illustrates a printing component embodiment.

FIG. 6A illustrates an embodiment of a portion 600 of an image processing device. The embodiment in FIG. 6A illustrates a printing portion 600 that includes a printing mechanism 610 according to various embodiments of the present invention. The embodiment in FIG. 6A, illustrates the printing mechanism, or printing device 610 operating on print media 601. The print media can include a sheet of print media or a continuous feed of print media. The invention is not so limited.

In the embodiment of FIG. 6A, a printing mechanism 610 includes a laser printing mechanism as the same will be understood by one of ordinary skill in the art. As shown in the embodiment of FIG. 6A, the laser printing mechanism 610 includes a laser source 612 and one or more mirrors or lenses 614.

A laser printing mechanism 610 uses electrostatic charges to create an image on a drum, adhere toner to the image, transfer the toned image to a print media, such as paper, and fuse the toner to the paper. A laser can create an image by "painting" a negative of a page to be printed on a charged drum and where light falls, a charge is dissipated leaving a positive image to be painted.

As shown in the embodiment of FIG. 6A, the laser printing mechanism 610 is operable to deposit a number of images 606 on the print media 601. As illustrated in the embodiment of FIG. 6A, the laser printing mechanism 610 is further operable to deposit one or more eye marks 608 having processing instructions, as the same have been described herein, on the print media 601. That is, in various embodiments, the printing mechanism is operable to deposit one or more eye marks 608 which consist of a pattern of multiple sections of different colors, e.g. Cyan, Magenta, Yellow and/or Light Cyan, Light Magenta, creating a color code that can be read by a combination of color sensors, such as described and discussed in connection with FIGS. 5A and 5B. Various numbers of color sections and various combinations of color sections can be included in various embodiments to clearly distinguish the eye marks 608 from the number of images 606.

As described above, any number of processing instructions, as the same have been described herein, can be included in the described eye marks 608 for operating on the print media 601. That is, processing instructions for operating on the print media 601, and the number of images 606 contained thereon, can be achieved using the various eye mark embodiments of the present invention.

As shown in the embodiment of FIG. 6A, the printing portion 600 of an image processing device can include an encoder or application module 650 operable on one or more sets of computer executable instructions to direct the laser printing mechanism 610 to deposit various eye marks 608, as described herein, at appropriate locations, e.g. associated with one or more images 606, on the print media 601. Computer executable instructions operable with the printing portion 600 can be received and operated on by the encoder or application model 650 from any other networked location within a system.

Figure 6B:
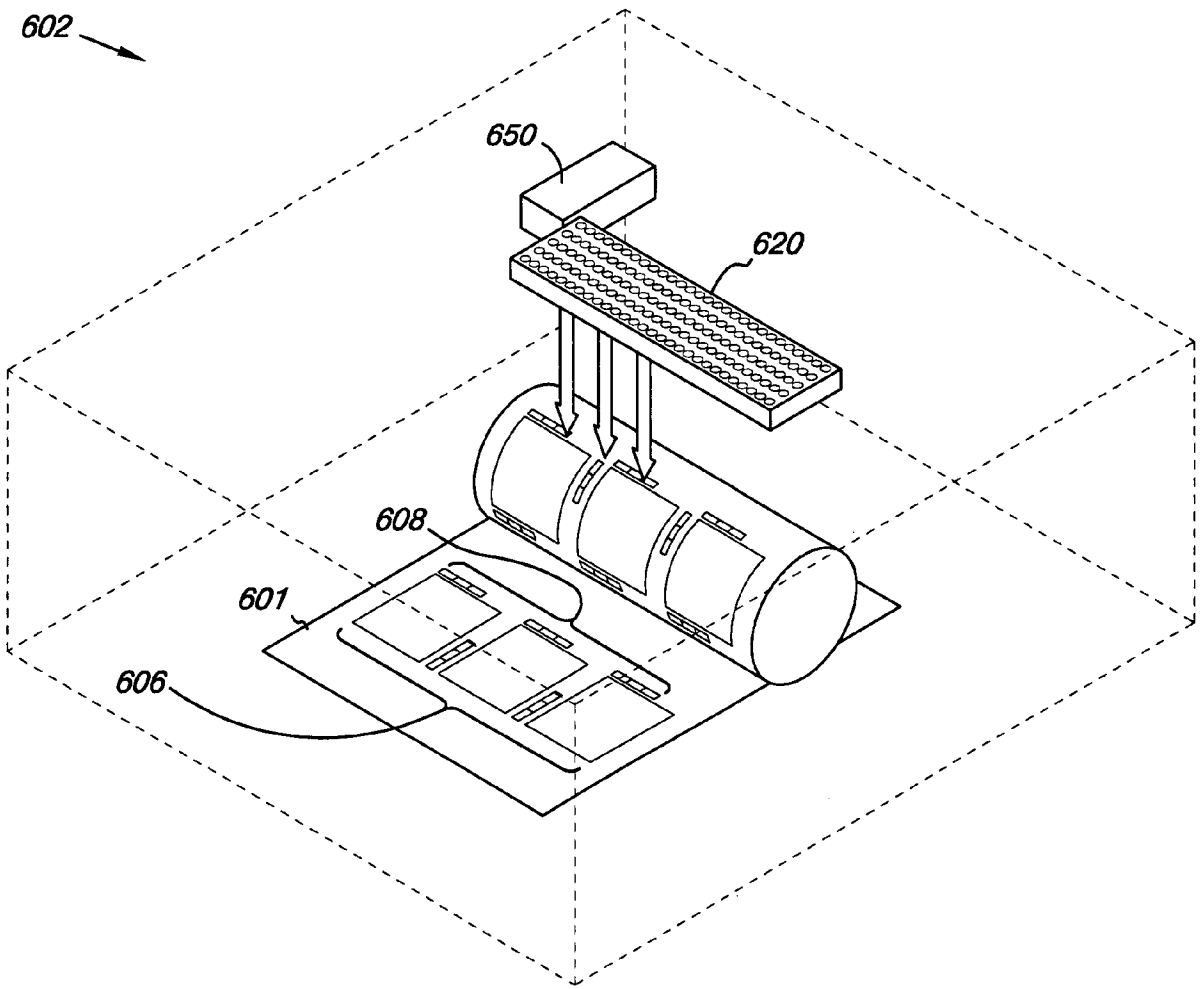
FIG. 6B illustrates another printing component embodiment.

FIG. 6B illustrates another embodiment of a printing portion 602 of an image processing device. The embodiment in FIG. 6B illustrates a printing portion 602 including a printing mechanism 620 according to various embodiments of the present invention. As above, the embodiment in FIG. 6B, illustrates the printing mechanism, or printing device 620 operating on print media 601. As above, the print media 601 can include any suitable print media. The invention is not so limited.

In the embodiment of FIG. 6B, a printing mechanism 620 includes an array of Light Emitting Diodes (LEDs) 620. LED printing mechanisms use an array of LEDs to beam an image onto a drum in a manner similar to that performed by a laser.

As shown in the embodiment of FIG. 6B, the LED printing mechanism 620 is operable to deposit a number of images 606 on the print media 601. As illustrated in the embodiment of FIG. 6B, the LED printing mechanism 620 is further operable to deposit one or more eye marks 608 having processing instructions, as the same have been described herein, on the print media 601. That is, in various embodiments, the printing mechanism is operable to deposit one or more eye marks 608 which consist of a side-by-side pattern of multiple sections of different colors, e.g. Cyan, Magenta, Yellow and/or Light Cyan, Light Magenta, creating a color code that can be read by a combination of color sensors, such as described and discussed in connection with FIGS. 5A and 5B. Various numbers, e.g. sections, of color sections and various combinations of color sections can be included in various embodiments to clearly distinguish the eye marks 608 from the number of images 606.

As described above, any number of processing instructions, as the same have been described herein, can be included in the described eye marks 608 for operating on the print media 601. That is, processing instructions for operating on the print media 601, and the number of images 606 contained thereon, can be achieved using the various eye mark embodiments of the present invention.

As shown in the embodiment of FIG. 6B, the printing portion 602 can include an encoder or application module 650 operable on one or more sets of computer executable instructions to direct the LED printing mechanism 620 to deposit various eye marks 608, as described herein, at appropriate locations, e.g. associated with one or more images 606, on the print media 601. Computer executable instructions operable with the printing portion 602 can be received and operated on by the encoder or application model 650 from any other networked location within a system.

Figure 6C:
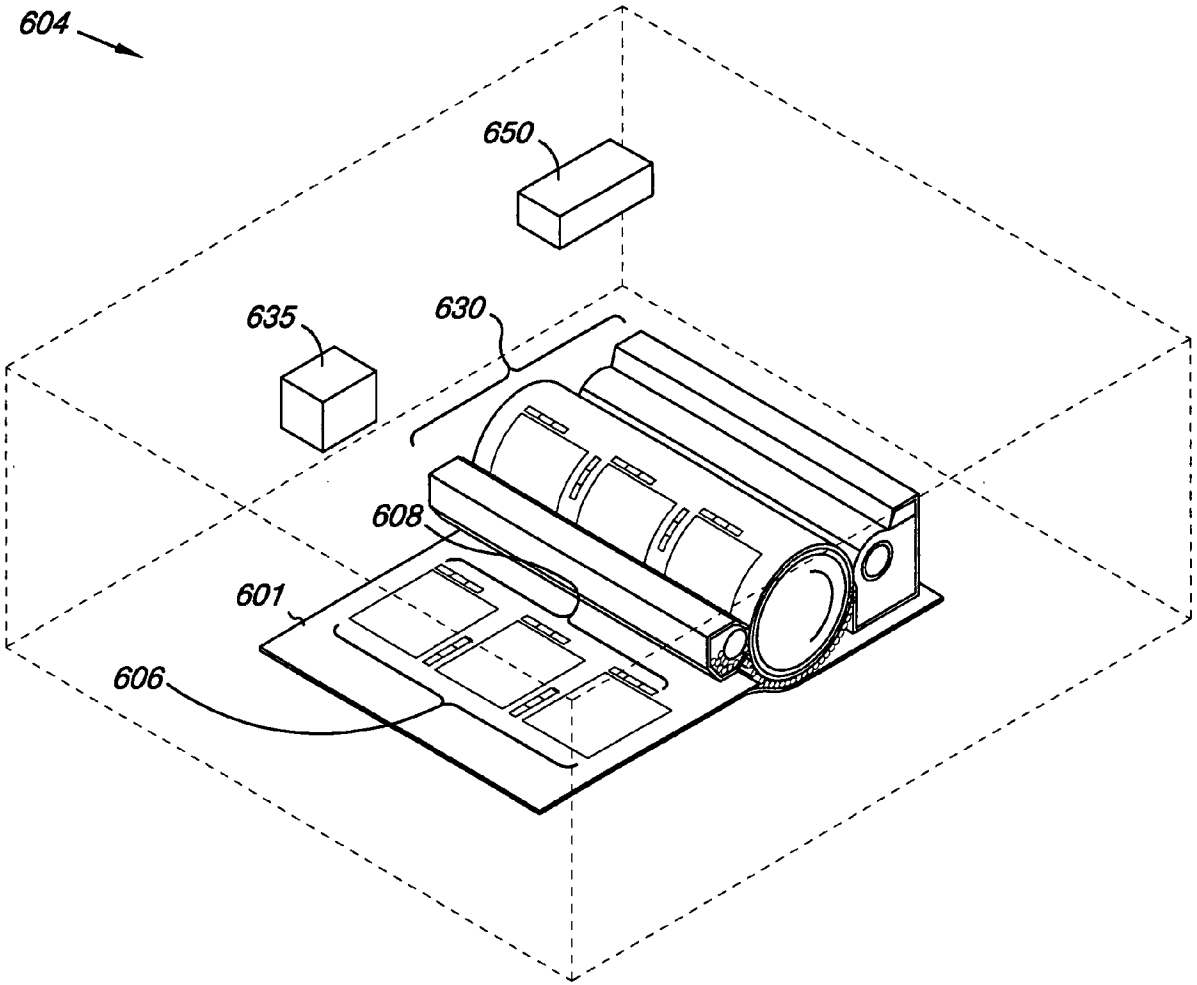
FIG. 6C illustrates another printing component embodiment.

FIG. 6C illustrates another embodiment of a printing portion 604 of an image processing device. The embodiment in FIG. 6C illustrates a printing portion 604 including a printing mechanism 630 according to various embodiments of the present invention. As above, the embodiment in FIG. 6C, illustrates the printing mechanism, or printing device 630 operating on print media 601. As above, the print media 601 can include any suitable print media. The invention is not so limited.

In the embodiment of FIG. 6C, a printing mechanism 630 includes a Liquid Electro-Photographic (LEP) printing mechanism 630. LEP printing mechanisms use electrostatic charges to create an image on a drum, adhere liquid toner to the image, transfer the liquid toned image to a print media, such as paper, and fuse the liquid toner to the paper. A light source 635 can create an image by "painting" a negative of a page to be printed on a charged drum and where light falls, a charge is dissipated leaving a positive image to be liquid toned.

As shown in the embodiment of FIG. 6C, the LEP printing mechanism 630 is operable to deposit a number of images 606 on the print media 601. As illustrated in the embodiment of FIG. 6C, the LEP printing mechanism 630 is further operable to deposit one or more eye marks 608 having processing instructions, as the same have been described herein, on the print media 601. That is, in various embodiments, the printing mechanism is operable to deposit one or more eye marks 608 which consist of a side-by-side pattern of multiple sections of different colors, e.g. Cyan, Magenta, Yellow and/or Light Cyan, Light Magenta, creating a color code that can be read by a combination of color sensors, such as described and discussed in connection with FIGS. 5A and 5B. Various numbers, e.g. sections, of color sections and various combinations of color sections can be included in various embodiments to clearly distinguish the eye marks 608 from the number of images 606.

As described above, any number of processing instructions, as the same have been described herein, can be included in the described eye marks 608 for operating on the print media 601. That is, processing instructions for operating on the print media 601, and the number of images 606 contained thereon, can be achieved using the various eye mark embodiments of the present invention.

As shown in the embodiment of FIG. 6C, the printing portion 604 can include an encoder or application module 650 operable on one or more sets of computer executable instructions to direct the LEP printing mechanism 630 to deposit various eye marks 608, as described herein, at appropriate locations, e.g. associated with one or more images 606, on the print media 601. Computer executable instructions operable with the printing portion 604 can be received and operated on by the encoder or application model 650 from any other networked location within a system.

Figure 6D:
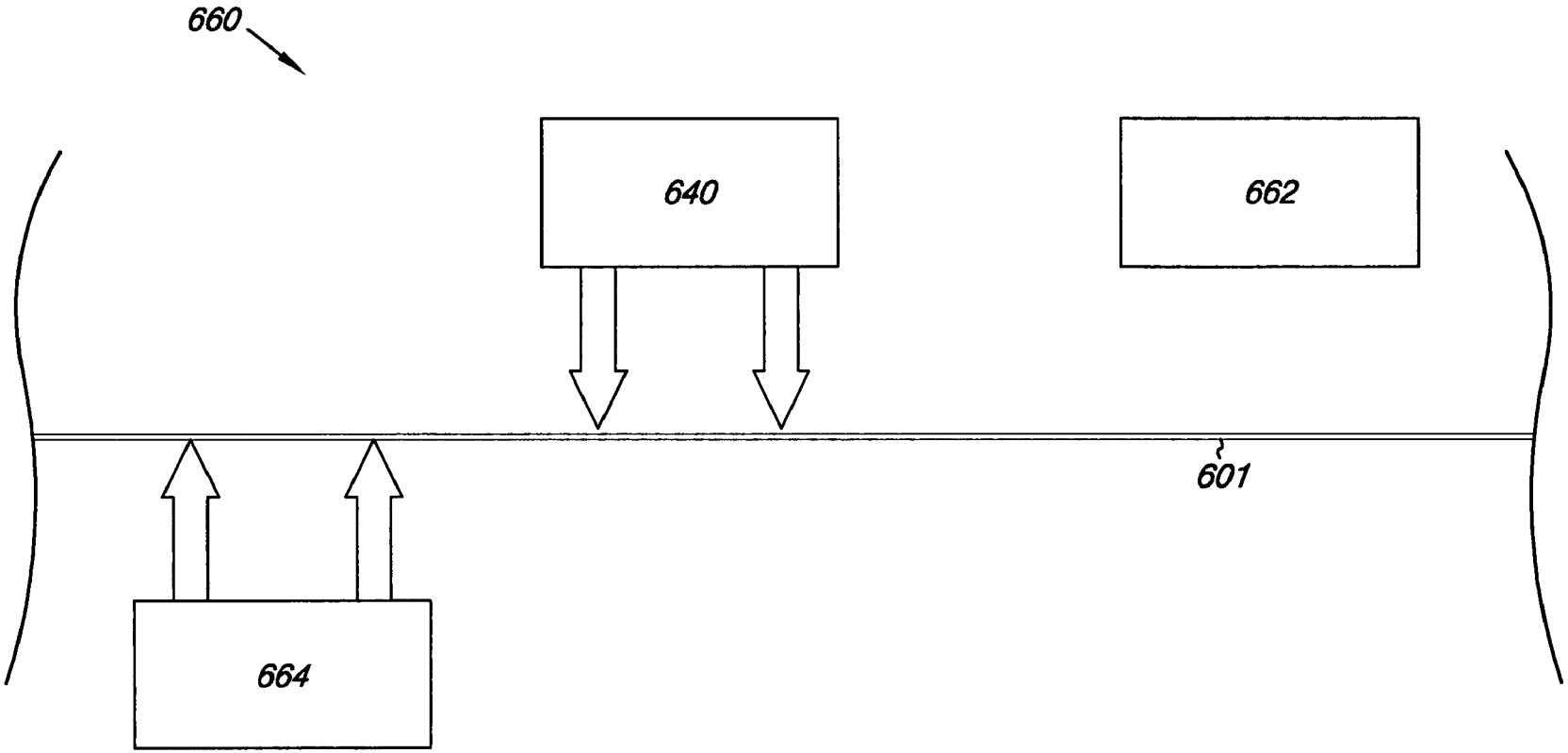
FIG. 6D illustrates another printing component embodiment.

FIG. 6D illustrates another embodiment of a printing portion 660 of an image processing device. The embodiment in FIG. 6D illustrates a printing portion 660 including a front side printing mechanism 640 and a back side printing mechanism 664 according to various embodiments of the present invention. The embodiment in FIG. 6D illustrates the front side printing mechanism 640 and the back side printing mechanism 664 operating on print media 601. As above, the print media 601 can include any suitable print media. The invention is not so limited.

The front side printing mechanism 640 can include any of the printing mechanisms discussed herein. However, the invention is not so limited. In various embodiments, as described herein, the front side printing mechanism 640 is operable to deposit a number of images on the print media 601. In various embodiments, the front side printing mechanism 640 is operable to deposit one or more eye marks having processing instructions, as the same have been described herein, on the print media 601. That is, in various embodiments, the printing mechanism 640 is operable to deposit one or more eye marks which consist of a side-by-side pattern of multiple sections of different colors, e.g. Cyan, Magenta, Yellow and/or Light Cyan, Light Magenta, creating a color code that can be read by a combination of color sensors, such as described and discussed in connection with FIGS. 5A and 5B. Various numbers, e.g. sections, of color sections and various combinations of color sections can be included in various embodiments to clearly distinguish the eye marks from a number of images on print media 601.

As described above, any number of processing instructions, as the same have been described herein, can be included in the described eye marks for operating on the print media 601. That is, processing instructions for operating on the print media 601, and the number of images contained thereon, can be achieved using the various eye mark embodiments of the present invention.

The back side printing mechanism 664 can include any of the printing mechanisms discussed herein. However, the invention is not so limited. That is, in various embodiments, the back side printing mechanism 664 can include a laser printer, an engraving device (as the same will be understood by one familiar with image processing), and/or a laser etching device, among other printing mechanisms, for printing information on a back or reverse side of the print media. The back side printing mechanism 664 can be employed to print any number of different types of information on a back or reverse side of the print media. By way of example and not by way of limitation, relevant back side print media information in image processing can include date and roll information for a number of images associated with a photo print job, information relating to a photo print job batch, information relating to the print job parameters, information relating to image layout and/or size (such as panoramic, close-up, 3×5, 4×6, etc), and/or information relating to image quality, among other information. The invention is not so limited. In various embodiments, back side printing mechanism 640 is operable to deposit a number of images on the back or reverse side of the print media 601, such as with dual sided or duplex printing. Further, in various embodiments, the back side printing mechanism 664 is operable to deposit eye marks, as the same have been described herein, on the back side of the print media 601.

As shown in the embodiment of FIG. 6D, the printing portion 604 can include an encoder or application module 662 operable on one or more sets of computer executable instructions to direct either and/or both of the front side printing mechanism 640 and the back side printing mechanism 664 to deposit information (as the same has been described herein), images and eye marks of the various embodiments. That is, in various embodiments, the encoder or application module 662 is operable on one or more sets of computer executable instructions to deposit various eye marks, as described herein, at appropriate locations, e.g. associated with one or more images on the print media 601. And, the various embodiments of eye marks themselves can be detected by a combination of sensors, such as described and discussed in connection with FIGS. 5A and 5B, and the detected information can be operated upon and/or processed by the encoder or application module 662 according to one or more sets of computer executable instructions to direct or control information, images, and/or eye marks deposited on the print media by another printing mechanism. That is, by way of example and not by way of limitation, information provided by eye marks of the various embodiments can be used to direct or instruct a printing mechanism, such as the back side printing mechanism 664, what information (such as date and roll information) to deposit on the print media 601. The invention is not so limited. Computer executable instructions operable with the printing portion 660 can be received and operated on by the encoder or application model 662 from any other networked location within a system.

Figure 7:
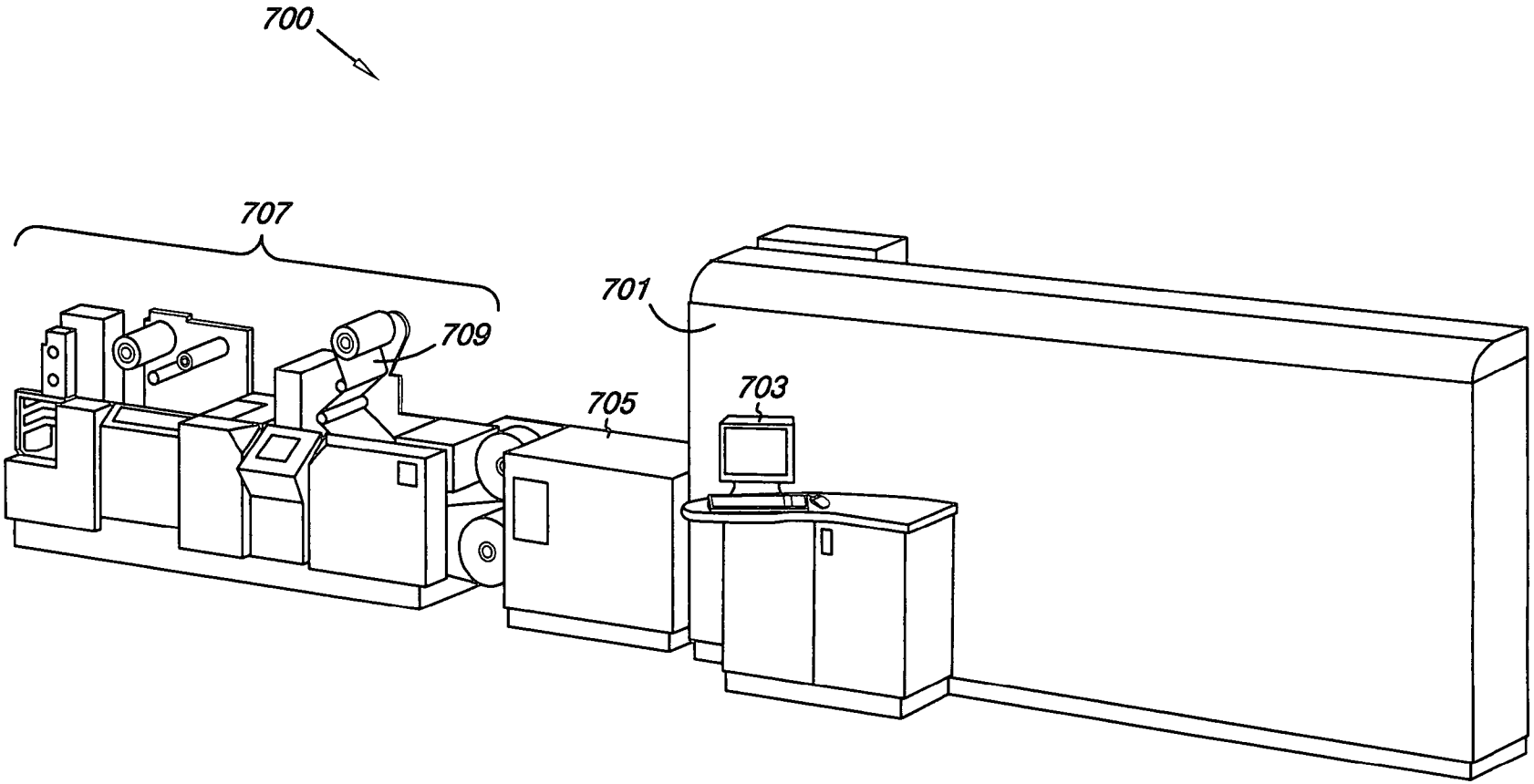
FIG. 7 illustrates a system embodiment.

FIG. 7 illustrates a system embodiment according to the teachings of the present invention. The embodiment of FIG. 7 illustrates an image processing system 700. The image processing system embodiment of FIG. 7 can include one or many of the embodiments described herein. The embodiment shown in FIG. 7 illustrates a printing portion 701 which can include embodiments such as described in connection with FIGS. 6A–6D. The embodiment of FIG. 7 illustrates a user or operator interface 703 as the same will be known and understood by one or ordinary skill in the art.

The embodiment shown in FIG. 7 illustrates a sensing device portion 705 which can include embodiments such as described in connection with FIGS. 5A–5B. The embodiment shown in FIG. 7 illustrates a finisher 707, which can include a cutting, sorting, and packing device, among other finishing components and equipment. The image processing system embodiment of FIG. 7 is operable on print media 709 which can include continuous strand or web of material having any number of images and eye marks, according to the various embodiments described herein. Eye marks of the various embodiments described herein can be detected, operated upon according to one or more sets of computer executable instructions to control and/or direct the operation of the image processing system 700 and the manner in which the image processing system 700 handles and/or operates on the print media 709.

Figure 8:
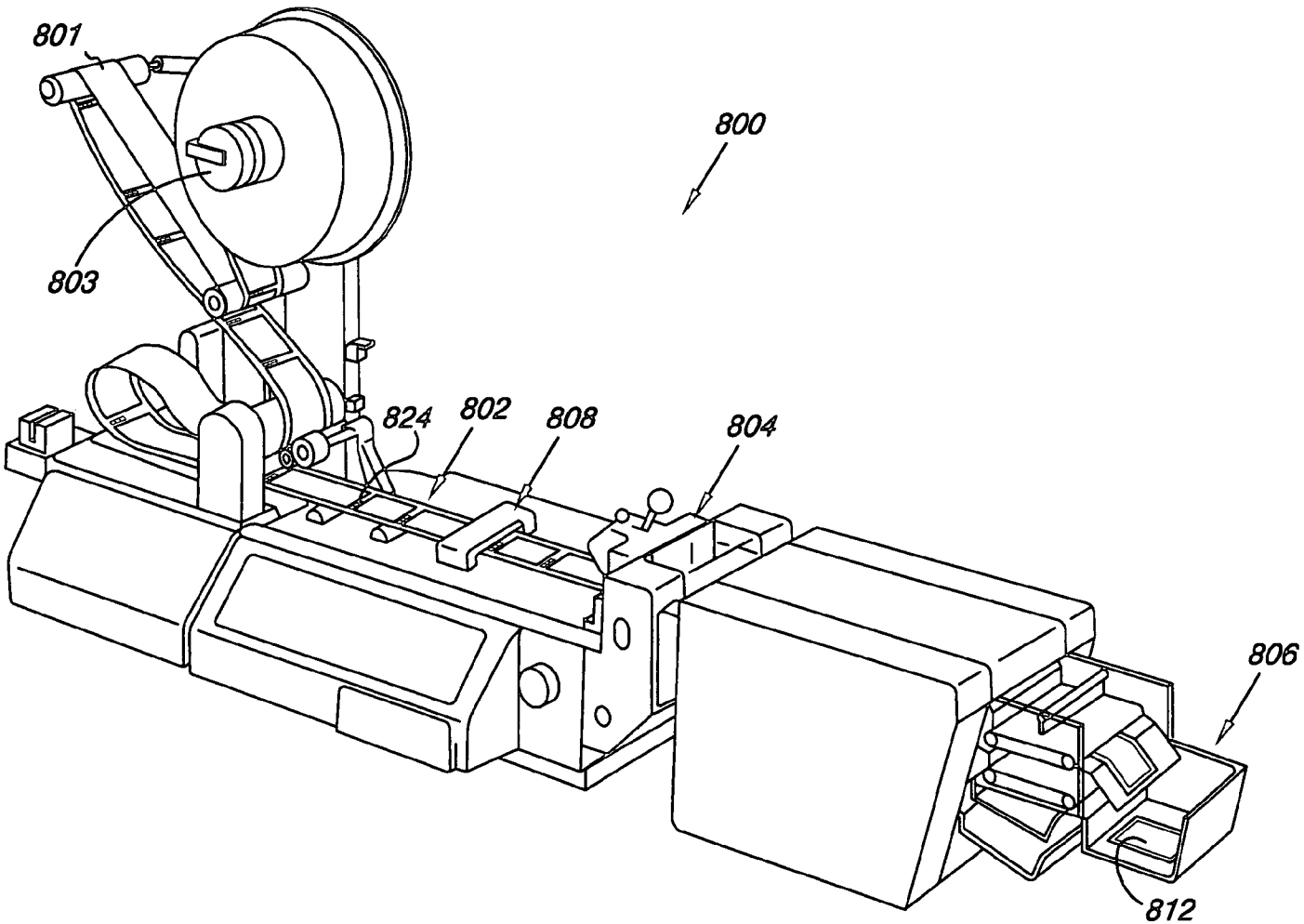
FIG. 8 illustrates a serial cutting device embodiment.

FIG. 8 illustrates serial cutting device embodiment according to the present invention. The cutting device 800 includes a roll of print media 801 suspended on an axle 803. The print media 801 is fed through the device 800, from left to right, and past a sensing component 808. The sensing component 808 scans the media 801 to identify an eye mark 824 thereon. Once an eye mark 824 is identified, the sensing component 808 reads the eye mark 824 and interprets its meaning. The meaning can be informational and/or instructional. In various embodiments, the eye mark 824 contains an instruction to cut the print media 801 at a specific position. Based upon such an instruction, the device 800 operates cutting component 804 to cut the print media 801 as instructed. The completed images 812 are placed in a completed image tray 806.

Figure 9A:
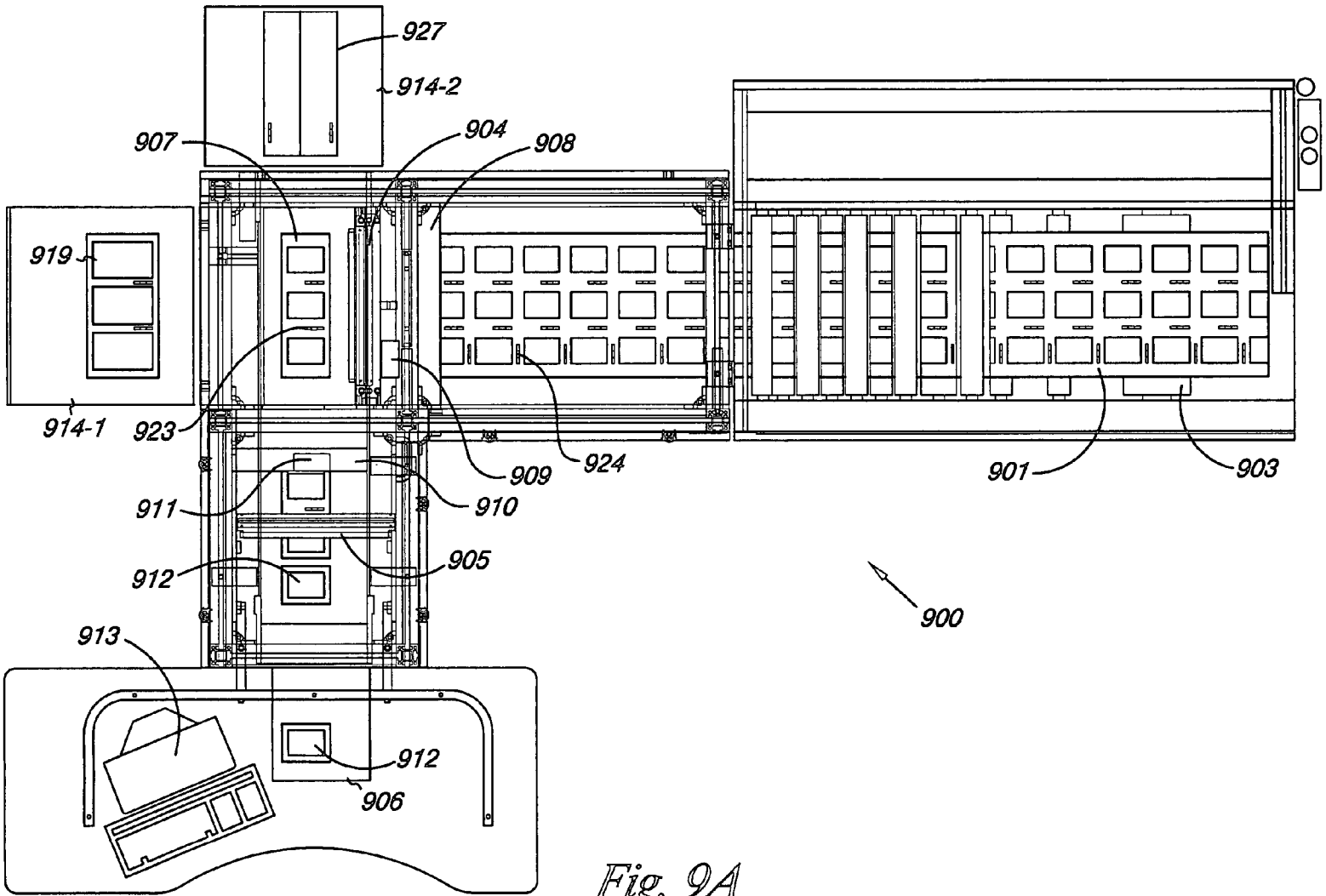
FIG. 9A is a top view of a matrix cutting device embodiment.
Figure 9B:
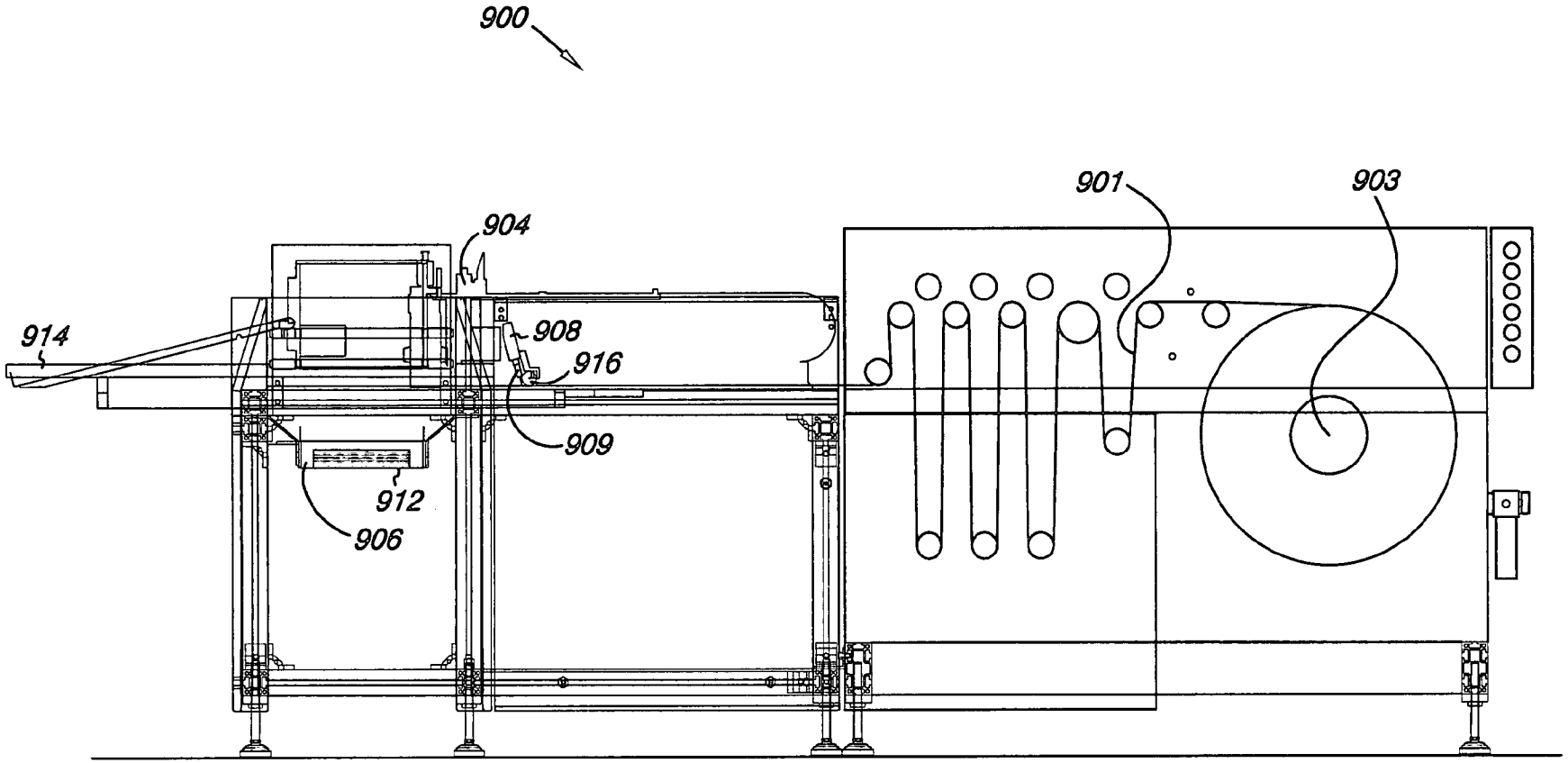
FIG. 9B illustrates a side view of the embodiment of FIG. 9A.

FIGS. 9A and 9B illustrate an embodiment of a matrix cutting device 900 that enables a sheet of print media to be cut in both a first dimension and a second dimension. This type of machine is suitable for use with the print media configurations shown in FIGS. 3A–4B. The embodiment of FIG. 9A includes a roll of print media 901 mounted on an axle 903, a first sensing component 908 having a first sensor 909, a first cutting component 904, a second sensing component 910 having a second sensor 911, a second cutting component 905, an over size structure 914-1, a waste structure 914-2, a user terminal 913, and a completed image tray 906 having several images 912 stacked therein.

FIG. 9A illustrates an over head view of a matrix cutting device according to the teachings of the invention. The media 901 progresses across the device 900 from right to left across surface 917 and under a sensing component 908 having a sensor 909. Based upon the instructions provided by the eye marks 924 thereon, the print medium 901 is cut into segments such as 907, 919, and 927 by a first cutting component 904.

In the embodiment shown in FIG. 9A, the segments 907/919/927 are then placed on a conveyor that can move the segment perpendicular to the right to left movement of the roll of print media 901. In this embodiment, a sorting feature is utilized wherein, based upon instructions provided by one or more of the eye marks 924 on the print media 901, each segment 907/919/927 can be sorted into several areas. For example, if the images are too large to continue to travel through the machine, such as the segment shown at 919, the segment 919 can be routed to an over size tray 914-1. If the print media that has been segmented is waste material, such as splice mark waste as shown at 927, calibration instructions, or the like, then the waste media 927 can be routed to a waste tray 914-2. As those skilled in the art will appreciate from reading this disclosure, one or more waste and/or over size trays can be located in any position around the device 900 and a single tray can be utilized to hold both waste and over sized images, the invention is not so limited.

In the embodiment shown in FIG. 9A, segmented print media 907 having images to be separated, can continue on the conveyor and under a second sensing component 910 having a sensor 911 thereon. In this embodiment, based upon the information provided by the eye marks 923 to the second sensing component 910, the segment of the print medium 907 is cut into images 912. Once the images 912 have been separated, the conveyor places them in a completed image tray 906.

A side view of the cutting device embodiment of FIG. 9A is illustrated in FIG. 9B. As in FIG. 9A, the print media 901 in FIG. 9B is fed through the device 900, from right to left, and past a sensing component 908. The sensing component 908 scans the media 901 to identify an eye mark 924 thereon. Once an eye mark 924 is identified, the sensor 909 reads the eye mark 924 and interprets its meaning. The meaning can be informational and/or instructional. In various embodiments, the eye mark 924 contains an instruction to cut the print media 901 at a specific position. Based upon such an instruction, the device 900 operates cutting component 904 to cut the print media 901 as instructed.

Figure 10:
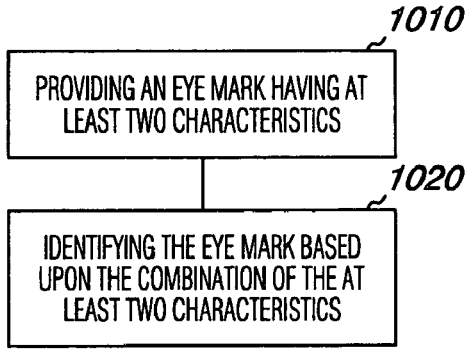
FIG. 10 illustrates a method embodiment for using eye marks.
Figure 11:
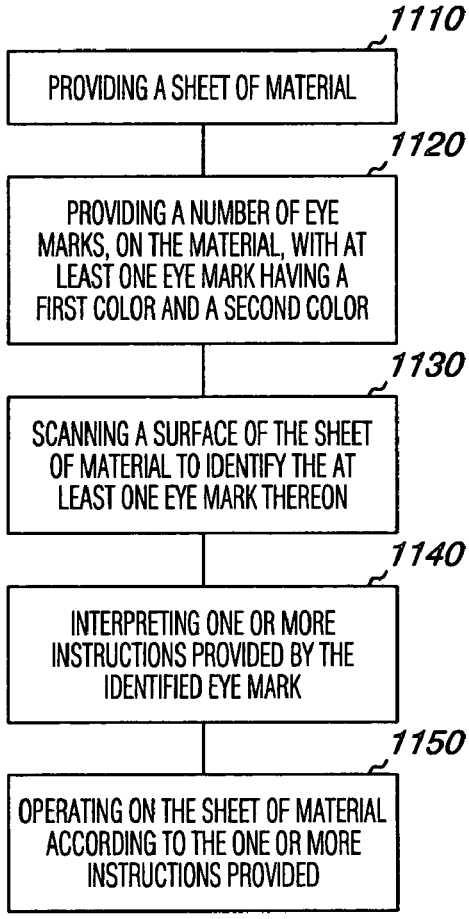
FIG. 11 illustrates a method embodiment for processing a sheet of material.
Figure 12:
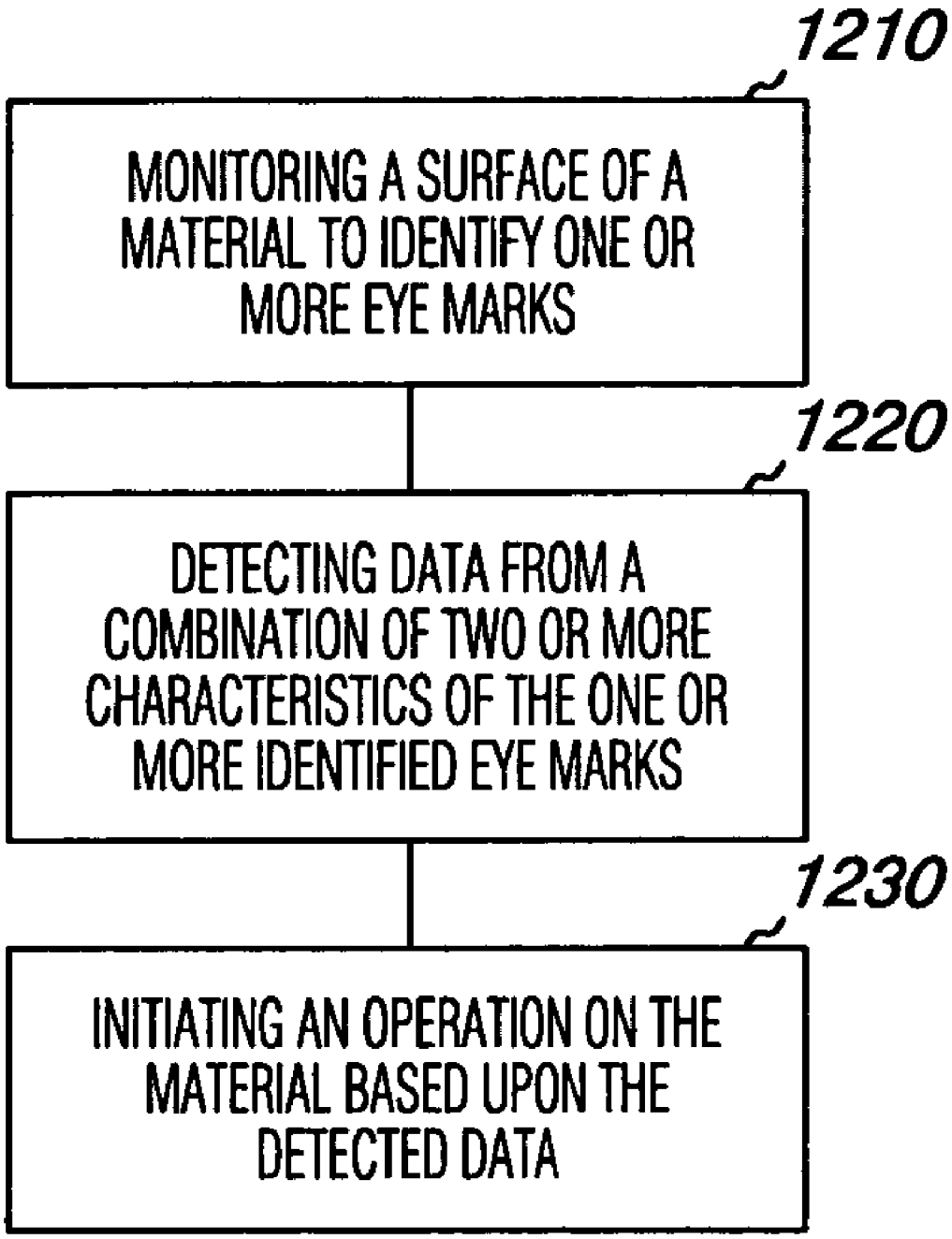
FIG. 12 illustrates another method embodiment for using eye marks.

FIGS. 10–12 are block diagrams illustrating various method embodiments of the invention. The methods can be performed by software, application modules, and computer executable instructions operable on the systems and devices shown herein or otherwise. The invention, however, is not limited to any particular operating environment or to software written in a particular programming language. Unless explicitly stated, the methods described below are not constrained to a particular order or sequence. Additionally, some of the so described methods can occur or be performed at the same point in time.

FIG. 10 illustrates a method embodiment for using eye marks. As illustrated in the embodiment of FIG. 10, the method includes providing an eye mark having at least two characteristics at block 1010.

In various embodiments, providing an eye mark having at least two characteristics can further include providing an eye mark having a first and a second color characteristic. Providing an eye mark having a first and a second color characteristic includes an eye mark having a first and a second color characteristic selected from the colors cyan, magenta, yellow, black, light cyan, light magenta, red, green, and blue. In various embodiments, providing an eye mark having at least two characteristics includes providing an eye mark having more than two color characteristics.

In various embodiments, providing an eye mark having at least two characteristics includes providing an eye mark having a black and white characteristic and a color characteristic. In various embodiments, providing an eye mark having at least two characteristics includes providing an eye mark having a color characteristic and a location characteristic. In various embodiments, providing an eye mark having at least two characteristics includes providing an eye mark having a first and a second shape characteristic. Providing an eye mark having a first and a second shape characteristic can include providing a first and a second shape characteristic which are different from one another. Additionally, in various embodiments, providing an eye mark having at least two characteristics includes providing a first and a second characteristic that have at least a three bit binary structure.

The method also includes identifying the eye mark based upon the combination of the at least two characteristics at block 1020. In various embodiments, identifying the eye mark based upon the combination of the at least two characteristics includes receiving information from the eye mark. Further, in various embodiments, the method can also include operating on print media based upon the received information.

FIG. 11 illustrates a method embodiment for processing print material. As illustrated in the embodiment of FIG. 11, the method includes providing a sheet of material at block 1110. As those skilled in the art will appreciate from reading the disclosure, providing a sheet of material includes providing a sheet of material having a number of images serially printed on the sheet. In various embodiments, providing a sheet of material can include providing a sheet of material having a number of images printed in a matrix. At block 1120, the method includes providing a number of eye marks, on the material, with at least one eye mark having a first color and a second color.

The method further includes scanning a surface of the sheet of material to identify the at least one eye mark thereon at block 1130. As those skilled in the art will appreciate from reading the disclosure, scanning a surface of the sheet can include scanning to identify the at least one eye mark by a particular combination of the first color and the second color.

The method also includes interpreting one or more instructions provided by the identified eye mark at block 1140. As those skilled in the art will appreciate from reading the disclosure, interpreting one or more instructions can include interpreting one or more instructions provided by a particular combination of the first color and the second color.

At block 1150, the method also includes operating on the sheet of material according to the one or more instructions provided. As those skilled in the art will appreciate from reading the disclosure, operating on the sheet can include operating on the sheet to cut it into segments according to one or more instructions. In various embodiments, operating on the sheet includes operating on the sheet to sort the segments. Further, in various embodiments, operating on the sheet according to one or more instructions can include operating on the sheet to calibrate a sensor using a color print scale printed on the sheet.

FIG. 12 illustrates another method embodiment for using eye marks. As illustrated in the embodiment of FIG. 12, the method includes monitoring a surface of a material to identify one or more eye marks at block 1210. At block 1220, the method includes detecting data from a combination of two or more characteristics of the one or more identified eye marks. The method also includes initiating an operation on the material based upon the detected data at block 1230.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature of the technical disclosure. It is submitted with the understanding that it will not be used to limit the scope of the claims.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for using eye marks, comprising:

providing an eye mark having at least two sections arranged along a longitudinal axis, wherein each section includes a border common to both sections and a unique characteristic relative to other sections;

encoding instructions in the eye mark based upon the combination of the at least two sections; and wherein providing an eye mark having at least two sections includes providing an eye mark having a color characteristic and a location characteristic for the at least two sections.

2. The method of claim 1, wherein providing an eye mark having at least two sections further includes providing the unique characteristic of each section of the eye mark as a first and a second color characteristic.

3. The method of claim 2, wherein providing the unique characteristic of each section of the eye mark as the first and the second color characteristic includes an eye mark having the first and the second color characteristic selected from the colors cyan, magenta, yellow, black, light cyan, light magenta, red, green, and blue.

4. The method of claim 1, wherein providing an eye mark having at least two sections includes providing an eye mark having more than two unique color characteristics.

5. The method of claim 1, wherein providing an eye mark having at least two sections includes providing an eye mark having a black and white characteristic and a color characteristic for the at least two sections.

6. The method of claim 1, wherein providing an eye mark having at least two sections includes providing an eye mark having a first and a second shape characteristic for the at least two sections.

7. The method of claim 6, wherein providing an eye mark having a first and a second shape characteristic includes providing a first and a second shape characteristic which are different from one another.

8. The method of claim 1, wherein providing an eye mark having at least two sections includes providing a first and a second characteristic for the at least two sections that have at least a three bit binary structure.

9. A method for using eye marks, comprising:

providing an eye mark, on a print media, having at least two color sections positioned along a longitudinal axis for parallel sensing, wherein each color section includes a border common to both sections and includes a different color characteristic relative other color sections; and encoding instructions in the eye mark based on the different color characteristics, wherein the encoded instructions further include a processing instruction.

10. The method of claim 9, wherein the method includes operating on the print media based on the processing instructions.

11. The method of claim 9, wherein providing an eye mark includes providing an eye mark having at least three color sections positioned for parallel sensing, wherein each color section includes a different color characteristic.

12. The method of claim 11, wherein providing an eye mark having at least three color sections includes providing each section with a different color selected from the group of cyan, magenta, yellow, light magenta, light cyan, red, green, and blue.

13. A computer readable medium having a set of computer executable instructions to cause a device to perform a method, comprising:

providing an eye mark having at least two sections arranged along a longitudinal axis, wherein each section includes a border common to both sections and a unique characteristic relative to other sections; and encoding instructions in the eye mark based upon the combination of the at least two sections, wherein the encoded instructions further include a processing instruction.

14. A computer readable medium having a set of computer executable instructions to cause a device to perform a method, comprising:

providing an eye mark, on a print media, having at least two color sections positioned along a longitudinal axis for parallel sensing, wherein each color section includes a border common to both sections and includes a different color characteristic relative other color sections;

encoding instructions in the eye mark based on the different color characteristics; and wherein providing an eye mark having at least two sections includes providing an eye mark having a color characteristic and a location characteristic for the at least two sections.

15. A method for using eye marks, comprising:

providing an eye mark having at least two sections arranged along a longitudinal axis, wherein each section includes a border common to both sections and a unique characteristic relative to other sections;

encoding instructions in the eye mark based upon the combination of the at least two sections; and wherein providing an eye mark having at least two sections includes providing a first and a second characteristic for the at least two sections that have at least a three bit binary structure.

* * * * *

UNITED STATES PATENT AND TRADEMARK OFFICE

CERTIFICATE OF CORRECTION

PATENT NO. : 7,225,738 B2
APPLICATION NO. : 10/719559
DATED : June 5, 2007
INVENTOR(S) : John A. Underwood et al.

It is certified that error appears in the above-identified patent and that said Letters Patent is hereby corrected as shown below:

In column 1, line 2, insert -- INTRODUCTION --.

Signed and Sealed this

Twelfth Day of August, 2008

JON W. DUDAS
*Director of the United States Patent and Trademark Office*